US005194368A

United States Patent [19]

Ueda et al.

[11] Patent Number: 5,194,368

[45] Date of Patent: * Mar. 16, 1993

[54] METHOD FOR PROCESSING SILVER HALIDE PHOTOGRAPHIC LIGHT-SENSITIVE MATERIALS

[75] Inventors: Shinji Ueda; Tetsuro Kojima; Tohru Kitahara; Tomokazu Yasuda; Yoshihiro Fujita; Takatoshi Ishikawa, all of Minami-Ashigara, Japan

[73] Assignee: Fuji Photo Film Co., Ltd., Minami-Ashigara, Japan

[ * ] Notice: The portion of the term of this patent subsequent to Oct. 22, 2008 has been disclaimed.

[21] Appl. No.: 427,831

[22] PCT Filed: Jan. 6, 1989

[86] PCT No.: PCT/JP89/00012

§ 371 Date: Sep. 6, 1989

§ 102(e) Date: Sep. 6, 1989

[30] Foreign Application Priority Data

Jan. 6, 1988 [JP] Japan ..... 63-10631
May 31, 1988 [JP] Japan ..... 63-133734
May 31, 1988 [JP] Japan ..... 63-133735

[51] Int. Cl.[5] ..... G03C 5/395; G03C 5/38

[52] U.S. Cl. ..... 430/400; 430/393; 430/398; 430/428; 430/429; 430/455; 430/460

[58] Field of Search ..... 430/398, 400, 460, 455, 430/393 428, 429, 567

[56] References Cited

U.S. PATENT DOCUMENTS 2,053,525 9/1936 Kieser .
4,204,930 5/1980 Ono et al. ..... 204/180
4,256,559 3/1981 Ono et al. ..... 204/180
4,618,569 10/1986 Kurematsu et al. ..... 430/428
4,756,918 7/1988 Ueda et al. ..... 430/393
4,804,617 2/1989 Nishikawa et al. ..... 430/393
4,948,711 8/1970 Kojima et al. ..... 430/393

FOREIGN PATENT DOCUMENTS 0252185 4/1971 European Pat. Off. .
53-60371 10/1973 Japan .
60-61039 4/1985 Japan .
1452618 10/1968 United Kingdom .
2054182 9/1975 United Kingdom .
2132635 7/1984 United Kingdom .

OTHER PUBLICATIONS

WPI data for JP 62-075525.
WPI data for JP 52-105820.
WPI data for DD 22,339.

*Primary Examiner*—Marion E. McCamish
*Assistant Examiner*—Janis L. Dote
*Attorney, Agent, or Firm*—Burns, Doane, Swecker & Mathis

[57] ABSTRACT

The present invention relates to a method for processing a silver halide photographic light-sensitive material having at least one silver halide emulsion layer containing silver iodide with a processing solution having fixing ability after developing the light-sensitive material. The object of the present invention is to speed up the fixing process in the foregoing method and to reduce the amount of waste liquor from the fixing process. The present invention is characterized in that the processing with the processing solution having fixing ability is performed while the processing solution is brought into contact with an anion-exchange resin and that 20 to 2,000 l of the processing solution per liter of the anion-exchange resin is brought into contact with the resin.

9 Claims, No Drawings

METHOD FOR PROCESSING SILVER HALIDE PHOTOGRAPHIC LIGHT-SENSITIVE MATERIALS

TECHNICAL FIELD

The present invention relates to a method for processing silver halide photographic light-sensitive materials having silver halide emulsion layer containing silver iodobromide and more specifically to a method for processing such photographic light-sensitive materials, which comprises a desilvering capable of rapidly fixing the light-sensitive materials and capable of reducing the amount of waste of a processing solution having fixing ability.

BACKGROUND TECHNIQUES

Basic processes for processing silver halide light-sensitive materials, for instance, color light-sensitive materials are a color developing process and a desilvering process. In the color developing process, the silver halide exposed to light is reduced with a color developing agent to form elemental silver and simultaneously the oxidized color developing agent reacts with a coupler to form dye images. In the subsequent desilvering process, the elemental silver formed during the color developing process is oxidized by the action of an oxidizing agent (in general, referred to as "bleaching agent") and then is dissolved by action of a complexing agent generally referred to as "fixing agent". Only the dye images remain on the color light-sensitive materials through such a desilvering process.

The desilvering process described above generally comprises two processing baths, one of which is a bleaching bath containing a bleaching agent and the other of which is a fixing bath containing a fixing agent; or one bath, i.e., a bleach-fixing bath simultaneously containing a bleaching agent and a fixing agent.

The practical development processing further comprises, in addition to the foregoing basic processes, a variety of auxiliary processes for the purpose of maintaining photographic and physical properties of images, enhancing storability of images or the like. Examples of such auxiliary processes or baths are a film hardening bath, a stopping bath, an image stabilizing bath and a water washing bath.

If a light-sensitive material composed of an emulsion containing silver iodine such as a color negative light-sensitive material for taking photographs is desilvered, it takes a long period of time and, therefore, there is a strong demand to develop a method in which the time required for desilvering can substantially be shortened.

It is also required to reduce the amount of waste liquor derived from photographic processing from the viewpoint of preventing environmental pollution and in the desilvering process, it becomes an important subject to reduce the amount of waste liquor, for instance, by reducing the amount of a fixing solution to be replenished.

Incidentally, there have been conducted various studies to develop a means for recovering silver as a valuable noble metal from bleach-fixing or fixing solutions, for instance, a method for recovering silver by introducing a bleach-fixing solution in an electrolytic cell and then electrolyzing it; a method for recovering silver by diluting the bleach-fixing solution to lower the solubility of a silver salt to precipitate the same; a method for recovering silver by adding sodium sulfide to these solutions in order to form silver sulfide; or a method for recovering silver, in the form of ions, by passing such a solution through a column packed with a large amount of an ion-exchange resin. Such means for recovering silver are detailed in, for instance, Kodak Publication, J-10 (Recovering Silver From Photographic Material), issued by Kodak Industrial Division; J. P. KOKOKU No. 58-22528; J. P. KOKAI No. 54-19496; Belgian Patent No. 869,087; and DEOS No. 2,630,661.

However, these methods are developed to recover silver from bleach-fixing solutions, but not to reuse the solutions obtained after the recovery of silver. Therefore, there are various obstacles to reuse such beach-fixing solutions after desilvering. For instance, the bleach-fixing solutions obtained after the desilvering cannot be reused or it is necessary to add components which are lost during the recovering of silver (addition of a regenerant) to reuse the same. As described above, it has not yet been realized to simultaneously reduce the amount of waste liquor and rapidly carry out the desilvering process while recovering silver.

Accordingly, an object of the present invention is to provide a method for processing silver halide photographic light-sensitive materials, which makes it possible to carry out a rapid fixing process compared with conventional methods and to reduce the amount of waste liquor of a processing solution having fixing ability.

DISCLOSURE OF THE INVENTION

The present invention relates to a method which comprises processing, with a processing solution having fixing ability, a silver halide photographic light-sensitive material composed of a substrate provided thereon with at least one silver halide emulsion layer containing silver iodide after developing it and which is characterized in that the processing with the processing solution having fixing ability is carried out while a part or whole thereof is brought into contact with an anion-exchange resin and that the amount of the processing solution having fixing ability to be brought into contact with the resin is adjusted to 20 to 2000 liters per liter of the anion-exchange resin.

In the method of this invention, the processing of the light-sensitive materials can continuously be performed by exchanging the used anion-exchange resin with new one at the time when the amount of the processing solution reaches 2000 liters or before it reaches the upper limit.

The inventors of this invention have conducted various studies and have found that a processing solution having fixing ability (hereunder sometimes referred to as "fixing processing solution") deteriorated through the processing of photographic light-sensitive materials containing silver iodide comprises a large amount of silver ions and a small amount of iodide ions and that the fixing ability thereof is extremely lowered by the action of both these ions. However, if silver ions present in the deteriorated processing solution having fixing ability is recovered by any means for recovering silver as described above, the thiosulfate serving as a fixing agent or sulfite ions serving as a preservative thereof are decomposed or removed during the recovery of silver.

Contrary to this, the inventors of this invention have found that the fixing ability of, the processing solution having fixing ability can be sufficiently recovered by removing iodide ions, although silver ions are still present therein and that the iodide ions among inorganic ions present in the solution can almost selectively be removed from the deteriorated processing solution by bringing it into contact with an anion-exchange resin. It is also found that there is a certain optimum range with respect to the cumulative amount of the processing solution having fixing ability to be in contact with anion-exchange resin per unit volume of the anion-exchange resin.

Moreover, if the time required for a processing with a bath having fixing ability and the subsequent water washing and/or stabilization processes is shortened (for instance, not more than 5 min.), it is liable to cause a problem of increasing magenta stain (Dmin) during continuous processing. However, if the processing is performed using an anion-exchange resin as in the present invention, such a problem does not arise. Therefore, the method is quite favorable for rapid processings. It is assumed that this is resulted from the removal of colored contaminants such as dyes by means of the anion-exchange resin.

In the method of this invention, 20 to 2000 l of a fixing processing solution per liter of an anion-exchange resin is brought into contact with the resin. More specifically, if more than 2000 l of the fixing processing solution is treated with one liter of the resin, iodide ions present therein are not sufficiently removed with the resin, while if less than 20 l of the fixing processing solution is treated with one liter of the resin, the amount of thiosulfate serving as a fixing agent removed by the resin in addition to iodide ions increases, which results in the necessity of supplementing a thiosulfate as a regenerant to the processing solution. In the latter case, the amount of the resin used increases and thus it is not preferred from the economical viewpoint. In addition, if silver ions are removed from the processing solution having fixing ability utilizing an ion-exchange resin, they are conventionally removed in the form of thiosulfate salts with the resin and, therefore, the fixing processing solution treated with the resin amounts to the order of 5 to 15 l per liter of the resin.

The light-sensitive materials which are processed by the method of the present invention comprise a silver halide emulsion layer. The light-sensitive material preferably comprises at least one silver halide emulsion layer containing at least one mole % of silver iodide, preferably 5 to 25 mole % and more preferably 7 to 20 mole %.

Therefore, the color light-sensitive material is formed by applying onto a substrate, at least one layer of silver halide emulsion which contains at least one silver iodide selected from the group consisting of silver iodide, silver iodobromide, silver chloroiodobromide and silver chloroiodide. In this respect, silver chloride and silver bromide may optionally be used in addition to the foregoing silver iodide.

The silver halide grains used in the color photographic light-sensitive materials of the present invention may be in the form of any crystalline forms such a regular crystalline form as a cubic, octahedral, rhombododecahedral or tetradecahedral form; such as irregular form as a spheric or tabular form; or a composite form thereof. In addition, they may be tabular grains having an aspect ratio of not less than 5 as disclosed in Research Disclosure, Vol. 225, pp. 20–58 (Jan., 1983). The silver halide grains may be those having epitaxial structure or those having a multilayered structure whose internal composition (such as halogen composition) differs from that of the surface region.

The average grain size of the silver halide is preferably not less than 0.5μ, more preferably not less than 0.7 and not more than 5.0μ.

The grain size distribution thereof may be either wide or narrow. The latter is known as so-called monodisperse emulsions whose dispersion coefficient is preferably not more than 20% and more preferably not more than 15%. The "dispersion coefficient" herein means the standard deviation divided by the average gain size.

The coated amount of silver in the light-sensitive materials of the present invention is generally 1 to 20 $g/m^2$, preferably 2 to 10 $g/m^2$, provided that the total amount of iodine (AgI) present in the silver halide light-sensitive materials is preferably not less than $4\times10^{-3}$ $mole/m^2$ and more preferably not less than $6\times10^{-3}$ $mole/m^2$ and not more than $4\times10^{-2}$ $mole/m^2$.

The silver halide emulsions may contain other salts or complexes such as cadmium salts, zinc salts, lead salts, thallium salts, iridium salts or complex salts thereof, rhodium salts or complex salts thereof and iron salts or complex salts thereof, which are added thereto during the formation of silver halide grains or physical ripening process.

The term "processing solutions having fixing ability" herein means a bleach-fixing solution or a fixing solution.

If the processing solution having fixing ability is a bleach-fixing solution, a bleaching accelerator may be used.

According to the method of this invention, iodide ions can be removed. As a result, the amount of the fixing processing solution replenished can be reduced and simultaneously the amount of waste liquor can be reduced. Therefore, the present invention is to provide a rapid processing method which can not cost and has low probability of causing environmental pollution.

Various commercially available resins may be used as the anion-exchange resins as used herein. In particular, in the present invention, basic anion-exchange resins are preferably used as such aninon-exchange resin.

Preferred basic anion-exchange resins used in the invention are represented by the formula (VIII):

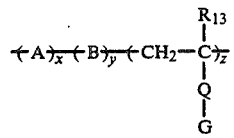

In the formula, A represents a monomer unit obtained by copolymerizing copolymerizable monomers having at least two ethylenically unsaturated copolymerizable groups and at least one of these groups is present in a side chain. B represents a monomer unit obtained by copolymerizing ethylenically unsaturated copolymerizable monomers. $R_{13}$ represents a hydrogen atom, a lower alkyl group or an aralkyl group.

Q represents a single bond, or an alkylene groups, a phenylene group, an aralkylene group, $$-\overset{O}{\overset{\|}{C}}-O-L-,\quad -\overset{O}{\overset{\|}{C}}-NH-L-\quad \text{or}\quad -\overset{O}{\overset{\|}{C}}-NR-L-.$$

Wherein L represents an alkylene, arylene or aralkylene group and R is an alkyl group.

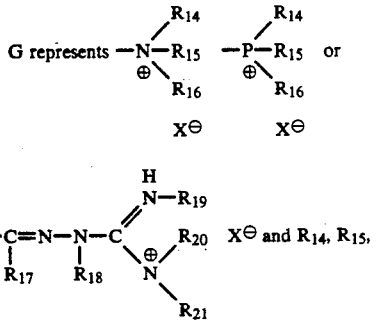

$R_{16}$, $R_{17}$, $R_{18}$, $R_{19}$, $R_{20}$ and $R_{21}$ may be the same or different and may be substituted and each represents a hydrogen atom, an alkyl, aryl or aralkyl group. $X^{\ominus}$ represents an anion. Two or more groups selected from Q, $R_{14}$, $R_{15}$ and $R_{16}$ or Q, $R_{17}$, $R_{18}$, $R_{19}$, $R_{20}$ and $R_{21}$ may be bonded to form a ring structure together with the nitrogen atom.

x, y and z each represents molar percentage, x ranges from 0 to 60, y from 0 to 60 and z from 30 to 100.

The forgoing general formula (VIII) will hereunder be explained is more detail. Examples of monomers from which A is derived are divinylbenzene, ethylene glycol dimethacrylate, diethylene glycol dimethacrylate, triethylene glycol dimethacrylate, ethylene glycol diacrylate, diethylene glycol diacrylate, 1,6-hexanediol diacrylate, neopentyl glycol dimethacrylate and tetramethylene glycol dimethacrylate and particularly divinylbenzene and ethylene glycol dimethacrylate are preferred.

A may comprise at least two of the foregoing monomer units.

Examples of ethylenically unsaturated monomer from which B is derived include ethylene, propylene, 1-butene, isobutene, styrene, α-methylstyrene, vinyltoluene, monoethylenically unsaturated esters of aliphatic acids (e.g., vinyl acetate and allyl acetate), esters of ethylenically unsaturated monocarboxylic acids or dicarboxylic acids (e.g., methyl methacrylate, ethyl methacrylate, n-butyl methacrylate, n-hexyl methacrylate, cyclohexyl methacrylate, benzyl methacrylate, n-butyl acrylate, n-hexyl acrylate and 2-ethylhexyl acrylate), monoethylenically unsaturated compounds (e.g., acrylonitrile), or dienes (e.g., buadiene and isoprene). Particularly preferred are styrene, n-butyl methacrylate and cyclohexyl methacrylate. B may comprise two or more of the foregoing monomer units.

$R_{13}$ preferably represents a hydrogen atom, a lower alkyl group having 1 to 6 carbon atoms such as a methyl, ethyl, n-propyl, n-butyl, n-amyl or n-hexyl group or an aralkyl group such as a benzyl group and particularly preferred are a hydrogen atom and a methyl group.

Q preferably represents a divalent optionally substituted alkylene group having 1 to 12 carbon atoms such as a methylene, ethylene or hexamethylene group, an optionally substituted arylene group such as a phenylene group, or an optionally substituted aralkylene group having 7 to 12 carbon atoms such as

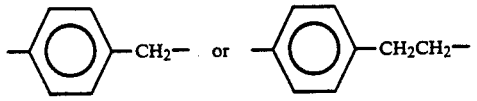

and groups represented by the following formulas are also preferred:

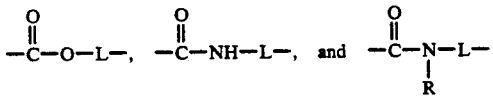

Wherein L preferably represents an optionally substituted alkylene group having 1 to 6 carbon atoms, or an optionally substituted arylene group or an optionally substituted aralkylene group having 7 to 12 carbon atoms, more preferably an optionally substituted alkylene group having 1 to 6 carbon atoms. R is preferably an alkyl group having 1 to 6 carbon atoms.

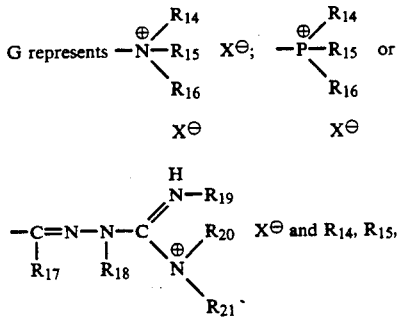

$R_{16}$, $R_{17}$, $R_{18}$, $R_{19}$, $R_{20}$ and $R_{21}$ may be the same or different and each represents a hydrogen atom, an alkyl having 1 to 20 carbon atoms, an aryl having 6 to 20 carbon atoms or an aralkyl group having 7 to 20 carbon atoms. These alkyl, aryl and aralkyl groups include substituted alkyl, aryl and aralkyl groups.

Examples of alkyl groups include such unsubstituted alkyl groups as methyl, ethyl, n-propyl, iso-propyl, n-butyl, iso-butyl, t-butyl, n-amyl, iso-amyl, n-hexyl, cyclohexyl, n-heptyl, n-octyl, 2-ethylhexyl, n-nonyl, n-decyl and n-dodecyl groups. The number of carbon atoms of the alkyl group preferably ranges from 1 to 16 more preferably 4 to 10.

Examples of substituted alkyl groups are alkoxyalkyl groups such as methoxy methyl, methoxyethyl, methoxybutyl, ethoxyethyl, ethoxypropyl, ethoxybutyl, butoxyethyl, butoxypropyl, butoxybutyl and vinyloxyethyl; cyanoalkyl groups such as 2-cyanoethyl, 3-cyanopropyl and 4-cyanobutyl; halogenated alkyl groups such as 2-fluoroethyl, 2-chloroethyl and 3-fluoropropyl; alkoxycarbonylalkyl groups such as ethoxycarbonylmethyl; allyl group, 2-butenyl group and propargyl.

Examples of aryl groups include such unsubstituted aryl groups as phenyl and naphthyl groups; such substituted aryl groups as alkylaryl groups (e.g., 2-methylphenyl, 3-methylphenyl, 4-methylphenyl, 4-ethylphenyl, 4-isopropylphenyl and 4-t-butylpheny); alkoxyaryl groups (e.g., 4-methoxyphenyl, 3-methoxyphenyl and 4-ethoxyphenyl); and aryloxyaryl groups (e.g., 4-phenoxyphenyl). The number of carbon atoms of the aryl group preferably ranges from 6 to 14, more preferably 6 to 10. Particularly preferred is a phenyl group.

Examples of aralkyl groups include unsubstituted aralkyl groups such as benzyl, phenethyl, diphenylmethyl and naphthylmethyl; substituted aralkyl groups such as alkylaralkyl groups (e.g., 4-methylbenzyl, 2,5-dimethylbenzyl and 4-isopropylbenzyl), alkoxyaralkyl groups (e.g., 4-methoxybenzyl and 4-ethoxybenzyl), cyanoaralkyl groups (e.g., 4-cyanobenzyl), perfluoroalkoxyaralkyl groups (e.g., 4-pentafluoropropoxybenzyl and 4-undecafluorohexyloxybenzyl) and halogenoaralkyl groups (e.g., 4-chlorobenzyl, 4-bromobenzyl and 3-chlorobenzyl). The number of carbon atoms of the aralkyl group preferably ranges from 7 to 15 and more preferably 7 to 11. Among these, benzyl and phenethyl groups are particularly preferred.

$R_{14}$, $R_{15}$ and $R_{16}$ each preferably represents an alky or aralkyl group, in particular they represent alkyl groups whose total number of carbon atoms ranges from 12 to 30.

$R_{17}$ to $R_{21}$ each preferably represents a hydrogen atom or an alkyl group.

$X^{\ominus}$ represents an anion such as a hydroxide ion, a halogen ion (e.g., chloride or bromide ion), an alkyl- or arylsulfonate ion (e.g., a methanesulfonate, ethanesulfonae, benzenesulfonate or p-toluenesulfonate ion), an acetate ion, a sulfate ions and a nitrate ion. Particularly preferred are chloride, acetate and sulfate ions.

At least two groups selected from Q and $R_{14}$ to $R_{16}$ may preferably be bonded to form a ring structure together with the nitrogen atom. Examples of such rings preferably include pyrrolidine, piperidine, morpholine, pyridine, imidazole and quinuclidine rings. Particularly preferred are pyrrolidine, morpholine, piperidine, imidazole and pyridine rings.

At least two groups selected from Q and $R_{17}$ to $R_{21}$ may be bonded to form a ring structure together with the nitrogen atom. Particularly preferred are 5- or 6-membered ring structures.

The basic anion-exchange resins of the invention may comprise two or more of the foregoing monomer units:

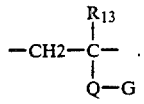

x ranges from b 0 to 60 mole %, preferably 0 to 40 mole %, and more preferably 0 to 30 mole %. y ranges from 0 to 60 mole %, preferably 0 to 40 mole % and more preferably 0 to 30 mole %. z ranges from 30 to 100 mole %, preferably 40 to 95 mole % and more preferably 50 to 85 mole %.

Among the compounds represented by formula (VIII), particularly preferred are those represented by the following general formula (IX):

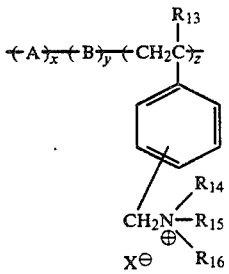

(IX)

In the formula, A, B, x, y, z, $R_{13}$ to $R_{16}$, and $X^{\ominus}$ are the same as those in the general formula (VIII).

More preferred are those represented by formula (IX) in which all of the groups $R_{14}$ to $R_{16}$ are alkyl groups whose total number of carbon atoms ranges from 12 to 30.

Specific examples of the basic anion-exchange resins of the present invention represented by the general formula (VIII) will be listed below, but the compounds of this invention are not restricted to these specific examples.

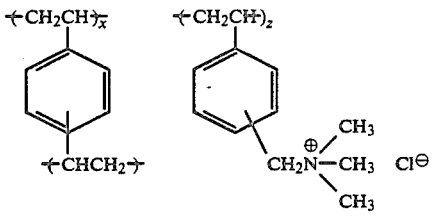

(1)

x:z = 10:90

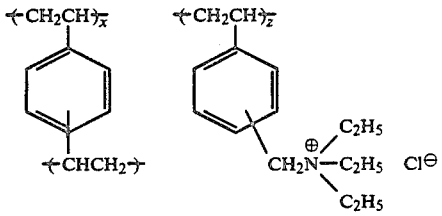

(2)

x:z = 25:75

-continued
(3)
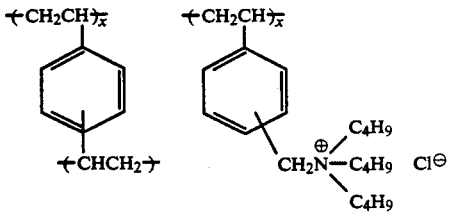
x:z = 31:69
(4)
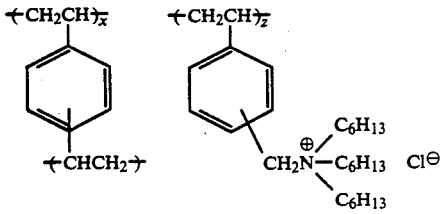
x:z = 33:67
(5)
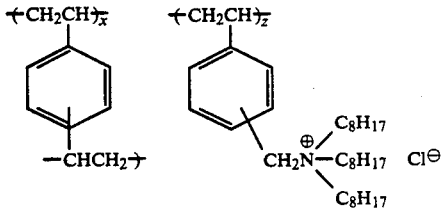
x:z = 30:70
(6)
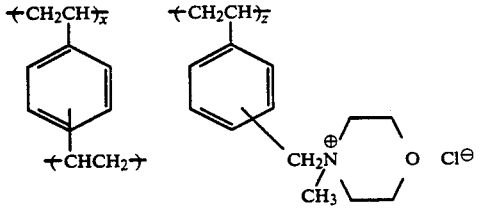
x:z = 10:90
(7)
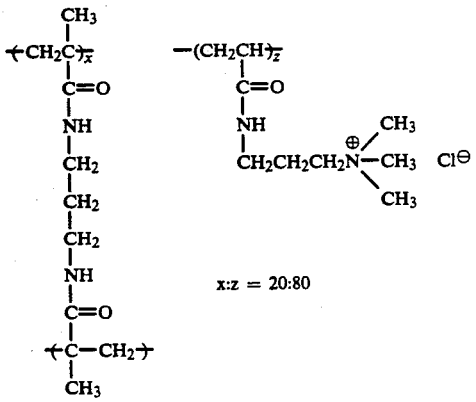
x:z = 20:80

-continued
(8)
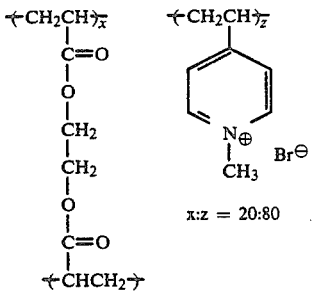
x:z = 20:80
(9)
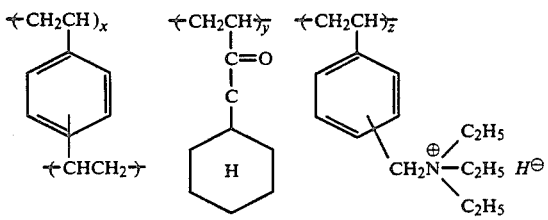
x:y:z = 20:20:60
(10)
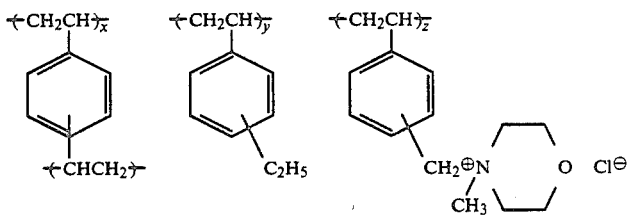
x:y:z = 5:47:48
(11)
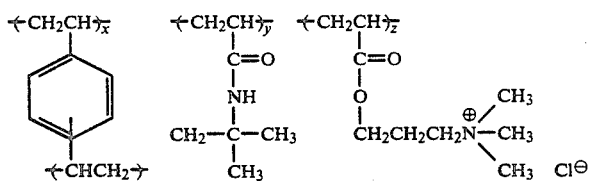
x:y:z = 10:40:50
(12)
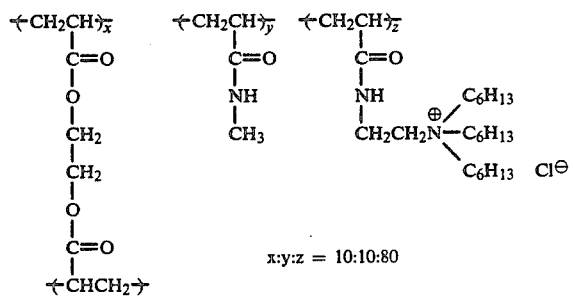
x:y:z = 10:10:80

-continued
(13)
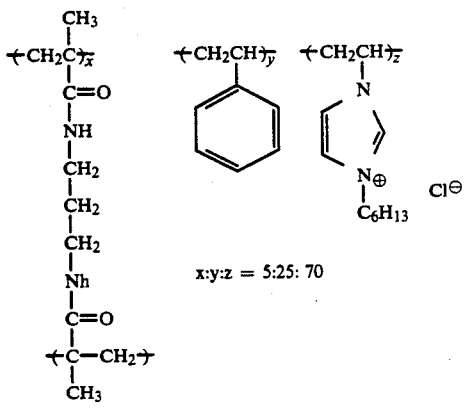
x:y:z = 5:25: 70
(14)
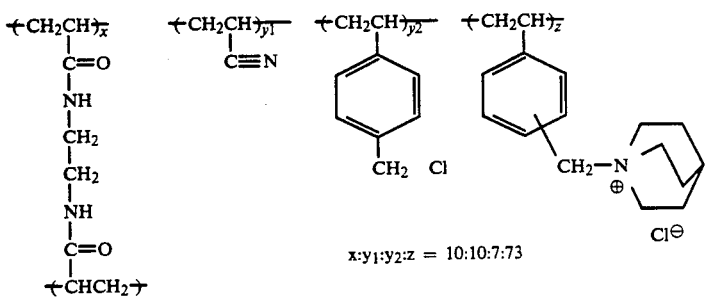
x:y1:y2:z = 10:10:7:73
(15)
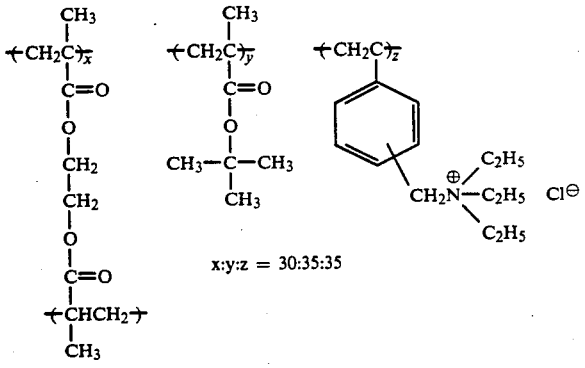
x:y:z = 30:35:35
(16)
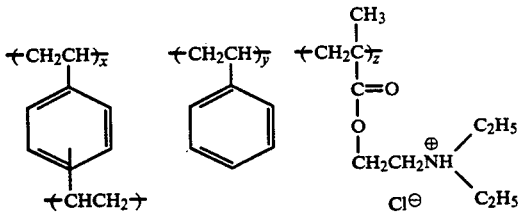
x:y:z = 15:5:80
(17)
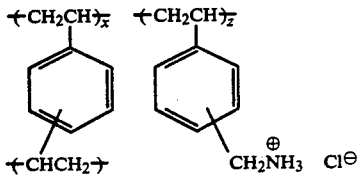
x:z = 36:64

-continued
(18)
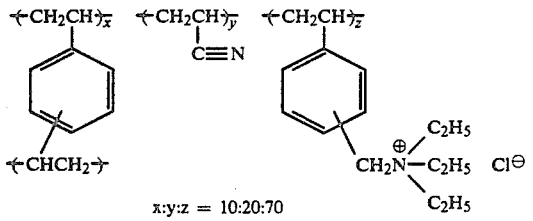
x:y:z = 10:20:70
(19)
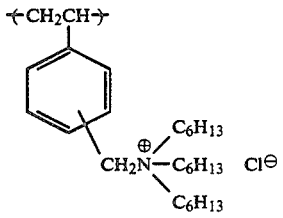
(20)
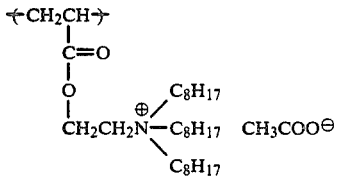
(21)
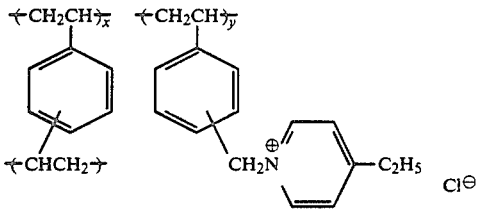
x:z = 20:80
(22)
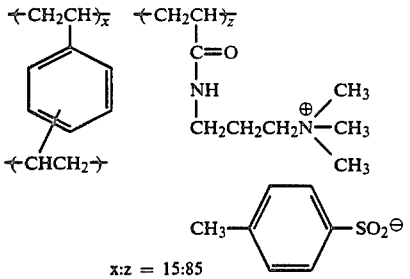
x:z = 15:85
(23)
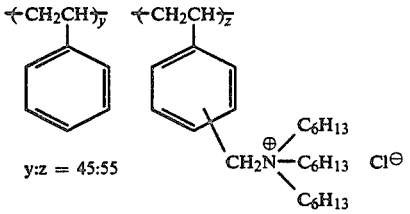
y:z = 45:55
(24)
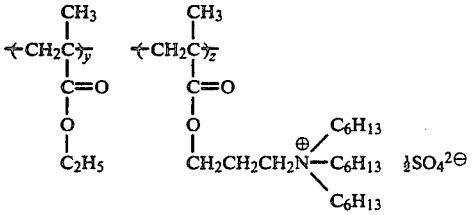
y:z = 40:60

-continued
(25)
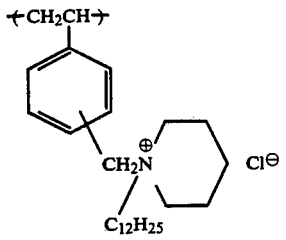
(26)
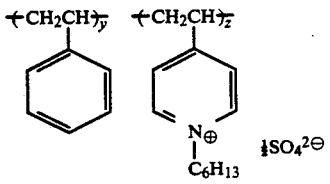
y:z = 25:75
(27)
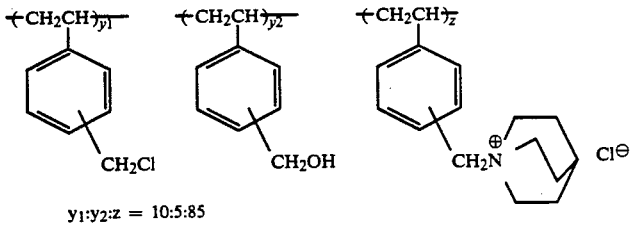
$y_1:y_2:z$ = 10:5:85
(28)
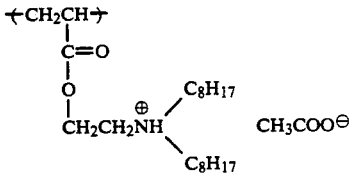
(29)
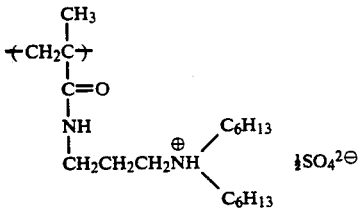
(30)
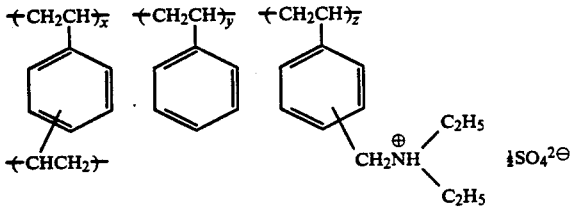
x:y:z = 15:10:75
(31)
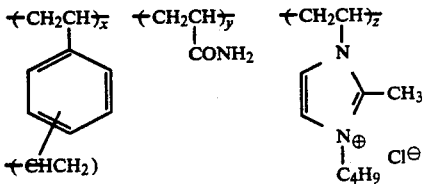
x:y:z = 10:15:75

-continued
(32)
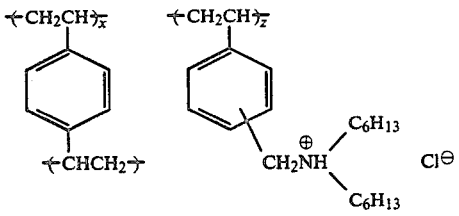
x:z = 10:90
(33)
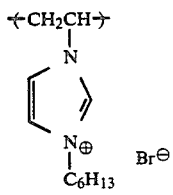
(34)
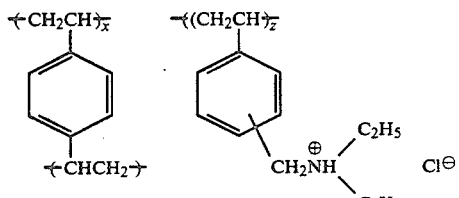
x:z = 10:90
(35)
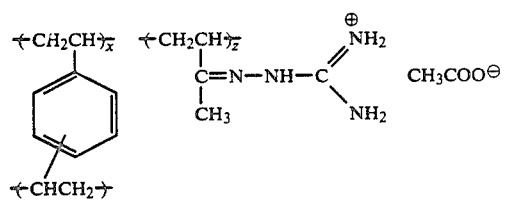
x:z = 30:70
(36)
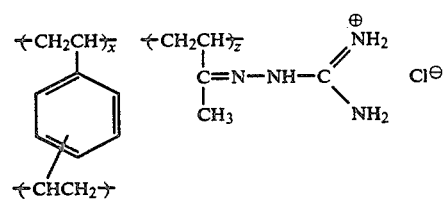
x:z = 20:80
(37)
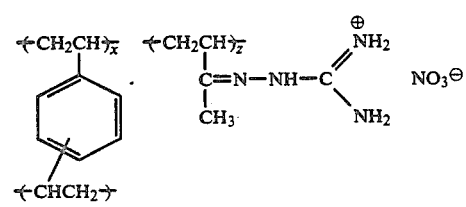
x:z = 25:75

-continued
(38)
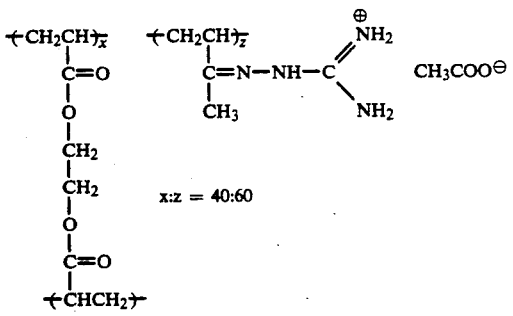
x:z = 40:60
(39)
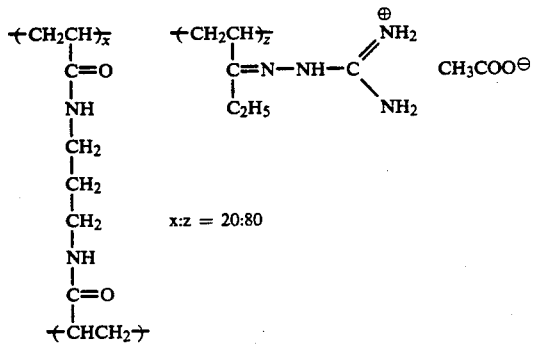
x:z = 20:80
(40)
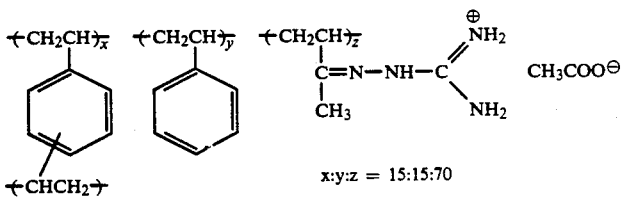
x:y:z = 15:15:70
(41)
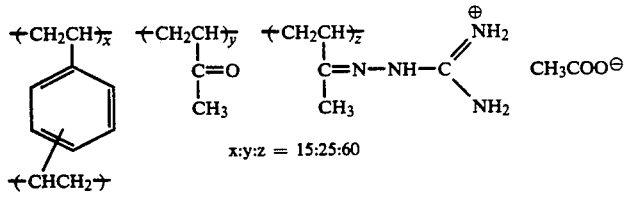
x:y:z = 15:25:60
(42)
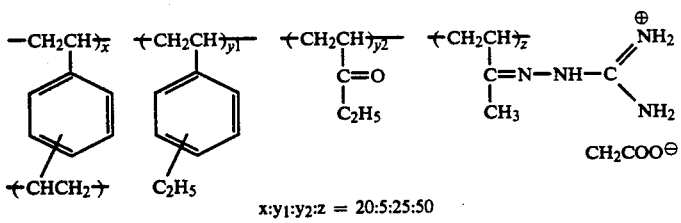
x:y1:y2:z = 20:5:25:50
(43)
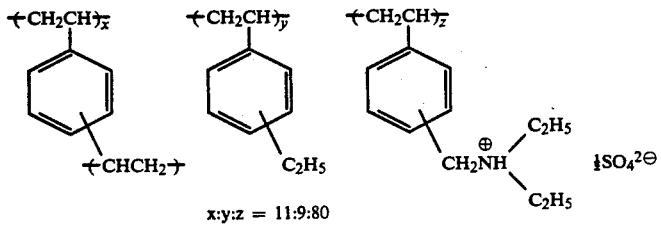
x:y:z = 11:9:80

-continued
(44)
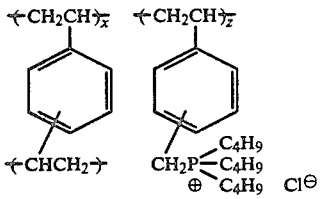
x:z = 30:70
(45)
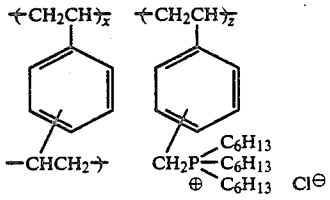
x:z = 30:70
(46)
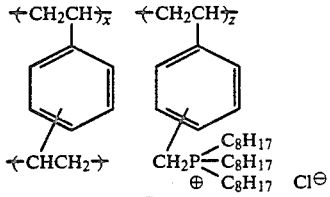
x:z = 25:75
(47)
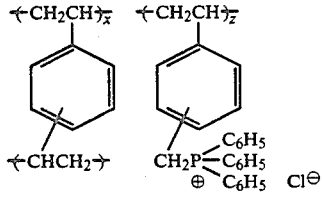
x:z = 30:70
(48)
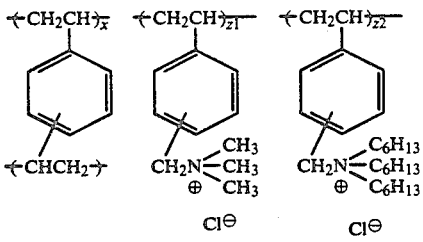
$x:z_1:z_2$ = 10:15:75
(49)
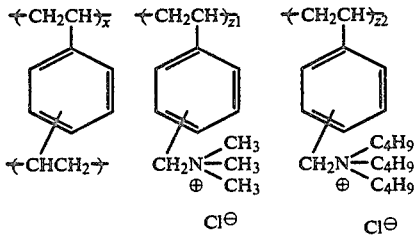
$x:z_1:z_2$ = 15:15:70

-continued (50)

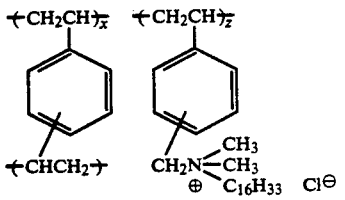

x:z = 30:70

(51)

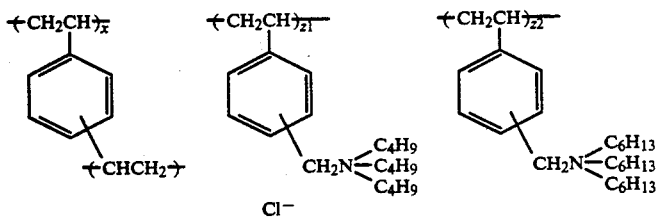

$x:z_1:z_2$ = 20:30:50

In the present invention, various commercially available resins may be used as a basic anion-exchange resins. specific examples thereof include Amberlite IRA-410, IRA-411, IRA-910, IRA-400, IRA-401, IRA-402, IRA 430, IRA-458, IRA-900, IRA-904 and IRA-938 (all these being available from Rohm & Haas Co., Ltd.); DIAION SA 10A, SA 12A, SA 20A, SA 21A, PA 306, PA 316, PA 318, PA 406, PA 412 and PA 418 (all these being available from MITSUBISHI CHEMICAL INDUSTRIES LTD.) and EPOLUS K-70 (available from MIYOSHI FAT & OIL CO., LTD.).

Moreover, they may be synthesized in accordance with the following Preparation Examples.

GENERAL METHOD FOR PREPARATION

The anion-exchange resins of this invention can be synthesized by quaternarizing a substantially water-insoluble resin having groups capable of being quaternarized with a tertiary amine or a tertiary phosphine (hereunder referred to as a "precursor resin") with a tertiary amine or a tertiary phosphine to introduce cations. The precursor resins may be prepared by a variety of methods as disclosed in J.P. KOKAI No. 59-39347, U.S. Pat. Nos. 2,874,132; 3,297,648; 3,549,562; 3,637,535; 3,817,878; 3,843,566; 2,630,427 and 2,630,429; German Patent No. 1,151,127 and J.P. KOKOKU Nos. 32-4143, 46-19044, 46-20054, 53-5294, 33-1 -2796, and 33-7397 or methods similar thereto.

The introduction of cationic groups into the precursor resin by quaternarization with a tertiary amine or phosphine can be carried out by using the foregoing precursor resin and a tertiary amine or phosphine according to methods as disclosed in J.P. KOKAI No. 59-39347; U.S. Pat. Nos. 2,874,132; 3,297,648; 3,549,562; 3,637,535; 3,817,878; 3,843,566; 2,630,327; 2,630,429; German Patent No. 1,151,127 and J. P. KOKOKU Nos. 32-4143, 46-19044; 46-20054, 53-5294; 33-2796 and 33-7397 or methods similar thereto.

Alternatively, the anion-exchange resin of this invention may also be obtained by using a substantially water-insoluble monomer having a copolymerizable ethylonically unsaturated group and a quaternary ammonium or phosphonium group in the foregoing methods for synthesizing the precursor resins or the methods similar thereto to form a resin.

Further, the anion-exchange resin of this invention may be obtained by using a monomer mixture of a substantially water-insoluble copolymerizable monomer having a quaternary ammonium or phosphonium group and an ethylenically unsaturated group and a substantially water-insoluble copolymerizable monomer having a group capable of being quaternarized with an amine or phosphine and an ethylenically unsaturated group in the foregoing methods for synthesizing the precursor resin or the methods similar thereto to obtain a resin and then introducing cations into the precursor resin according to the foregoing methods for quaternarization with a tertiary amine or phosphine or the methods similar thereto.

PREPARATION EXAMPLE 1

Preparation of poly(divinylbenzene-co-chloromethylstyrene)

To a 3 l three-decked flask equipped with a stirrer, a thermometer and a cooling tube, there were introduced, at room temperature, 1500 g of water, 2.5 g of polyvinyl alcohol (available from The Nippon Synthemical Chemical Industry Co., Ltd. under the trade name of GOSENOL) and 80 g of sodium chloride and they were sufficiently stirred to dissolve. To the solution, there was added, at room temperature, a solution of 206 g of chloromethylstyrene (available from Seimi Chemical Co., Ltd. under the trade name of CMS-AM), 19.5 g of divinylbenzene, and 4.0 g of benzoyl peroxide in 200 g of toluene and the solution was stirred for one hour at 110 rpm in a nitrogen gas stream. The temperature of the solution was raised to 70° C. to perform the reaction of 7 hours, followed by filtering off the resulting resin spheres, immersing the resin in 5 l of warm water of 50° C. to subject it to ultrasonic washing for 30 min. The resin was likewise washed with 2 l of methanol, 2 l of acetone and 2 l of ethyl acetate, dried at 100° C. under a reduced pressure to obtain 221.2 g of spherical resin particles having a particle size of not more than 1 mm. The resin was subjected to elemental analysis to determine the content of chlorine and it was confirmed that the content was $5.89\times10^{-3}$ mole/g resin.

Preparation of
Poly(divinylbenzene-co-tributylammonio-methylstyrene chloride) (Compound 3)

20 g of poly(divinylbenzene-co-chloromethylstyrene) spherical particles prepared above was weighed and put in a 500 ml 3-necked flask equipped with a stirrer, a thermometer and a cooling tube followed by adding 40 g of isopropyl alcohol, 40 g of dimethylacetamide and 40 g of tributylamine and swelling the resin for 7 hours at room temperature with stirring. The resin was heated to 85° C. to react it for 8 hours under refluxing. Then, the reaction system was cooled to room temperature and solid contents (spherical resin particles) were filtered off. The resin spheres were immersed in warm water of 50° C. to perform ultrasonic washing for 30 min., followed by repeating ultrasonic washing using 2 l of methanol, 2 l of acetone, 2 l; of ethyl acetate and 2 l of acetone in this order for every 20 min. and drying at 120° C. umder a reduced pressure to obtain 38.6 g of spherical resin particles. The chloride ion content was $2.70\times10^{-3}$ (mole/g resin).

The chloride ion content was determined by swelling the ground resin in 1N sodium nitrate solution and titrating the solution with 0.1N silver nitrate.

PREPARATION EXAMPLE 2

Preparation of
N-vinylbenzyl-N,N,N-trihexylammonium chloride 54.9 g (0.36 mole) of chloromethylstyrene, 80.7 g (0.30 mole) of tri-n-hexylamine, 0.5 g of nitrobenzene as a polymerization inhibitor and 400 ml of acetonitrile were fed to 1 l 3-necked flask and they were refluxed under heating for 7 hours with stirring.

After cooling to room temperature, the solution was washed with 500 ml of n-hexane several times to remove unreacted chloromethyl-styrene. The solution was concentrated to precipitate crystals and the crystals were recrystallized from 500 ml of ethyl acetate to obtain 103.89 g of intended N-vinylbenzyl-N,N,N-trihexylammonium chloride as white crystals (yield: 82.1%). The molecular structure of the resultant compound was confirmed by 'H-NMR and elemental analysis.

Preparation of
Poly(divinylbenzene-co-trihexylammoniomethylstyrene chloride) (Compound 4)

288 g of water and 143.5 g (0.34 mole) of N-vinylbenzyl-N,N,N-trihexylammonium chloride were introduced into a 3 l 3-necked flask equipped with a stirrer, a thermometer and a cooling tube to let sufficiently absorb water to thus obtain an oily substance. To the oily substance, there were added 7.8 g (0.06 mole) of divinylbenzene and 3.0 g of azobisisobutyronitrile (available from WACO JUNYAKU Co., LTD. under the trade name of V60) and the mixture was stirred to dissolve. Further, a solution of 1080 g calcium chloride and 2.3 g of polyvinyl alcohol (the same as that used above) in 1152 g of water was added to the resultant solution and the solution was stirred at room temperature for 30 min. at 135 rpm in a nitrogen gas stream. the temperature of the solution was raised to 70° C. and was stirred for 6 hours.

The solution was cooled to room temperature, the solid contents were filtered off and they were subjected to ultrasonic washing in 2 l of distilled water maintained at 50° C. for 30 min. Then, the ultrasonic washing was repeated using 2 l of methanol, 2 l of acetone and 2 l of ethyl acetate as solvents and the solid was dried at 100° C. under a reduced pressure to obtain 122.6 g of spherical particles. The chlorine content thereof was $1.8\times10^{-3}$ (mole/g resin).

PREPARATION EXAMPLE3

Preparation of
Poly(divinylbenzene-co-trihexylammoniomethylstyrene chloride-co-chloromethylstyrene)

There were introduced, into a 5 l 3-necked flask equipped with a stirrer, a thermometer and a cooling tube, 360 g of water and 84.4 g (0.2 mole) of N-vinylbenzyl-N,N,N-trihexylammonium chloride to let sufficiently absorb water to thus obtain an oily substance. To the oily substance, there were added 10.4 g (0.08 mole) of divinylbenzene, 18.3 g (0.12 mole) of chloromethylstyrene (the same as that used above) and 2.9 g of azobisisobutyronitrile (the same as that used above) and the mixture was stirred to dissolve. To the solution, there was added a solution of 864 g of calcium chloride and 2.0 g of polyvinyl alcohol (the same as that used above) in 930 g of water followed by stirring the mixture at room temperature, for 30 min. at 120 rpm in a nitrogen gas stream. The temperature of the solution was raised to 80° C. and the solution was stirred for 7 hr.

The solution was cooled to room temperature followed by filtering off the solid contents obtained and subjecting them to ultrasonic washing in 2 l of distilled water maintained at 50° C. for 30 min. The ultrasonic washing was repeated using 2 l each of methanol, acetone and ethyl acetate as solvents and the solid contents were dried at 100° C. under a reduced pressure to obtain 95.2 g of spherical particles. The resultant resin was analyzed by elemental analysis and it was found that the total chlorine content thereof was $2.78\times10^{-3}$ (mole/g resin). In addition, the resin was titrated to obtain chloride ion content and it was found to be $1.65\times10^{-3}$ (mole/g/resin).

Preparation of
Poly(divinylbenzene-co-tributylammoniomethylstyrene Chloride-co-trihexylammoniamethylstyrene Chloride) (Compound 51)

There was introduced 75 g of the spherical particles of poly(divinylbenzene-co-trihexylammoniomethylstyrene chloride-co-chloromethylstyrene) into an 1 l 3-necked flask provided with a stirrer, a thermometer and a cooling tube and 100 ml of isopropyl alcohol, 100 ml of acetonitrile and 150 g of tributylamine were added thereto to swell the polymer at room temperature for 7 hr. with stirring. The solution was heated to 80° C. to cause a reaction of 9 hr. with refluxing the solvent. Thereafter, the reaction system was cooled to room temperature and the resultant solid contents (spherical resin particles) were filtered off. The spherical resin was immersed in warm water of 50° C. to carry out ultrasonic washing for 30 min. and it was repeated using 2 l each of methanol, acetone, ethyl acetate and acetone in this order.

PREPARATION EXAMPLE 5

Preparation of
Poly(divinylbenzene-co-chloromethylstyrene)

There were introduced, at room temperature, 3000 g of water, 5.0 g of polyvinyl alcohol (available from The Nippon Synthemical Chemical Industry Co., Ltd. under the trade name of GOSENOL) and 160 g of sodium chloride into a 5 l 3-necked flask equipped with a stirrer, a thermometer and a cooling tube and the mixture was sufficiently stirred to dissolve. To the solution, there was added a solution of 412 g of chloromethylstyrene (available from SEIMI Chemicals Co., Ltd. under the trade name of CMS-AM), 43.4 g of divinylbenzene and 8.0 g of benzoyl peroxide in 500 g of toluene at room temperature, followed by stirring the solution for 30 min. at 120 rpm in a nitrogen gas stream, raising the temperature to 70 ° C. and reacting for 7 hr. After the reaction, the resulting spherical resin particles were filtered off, followed by immersing them in 5 l of warm water of 50° C. to perform ultrasonic washing for 30 min., likewise repeating the ultrasonic washing using 2 l each of methanol, acetone and ethyl acetate and drying at 100° C. under a reduced pressure to obtain 440 g of spherical resin particles having a particle size of not more than 1 mm. The resin was subjected to elemental analysis and the chlorine content thereof was found to be $5.85\times10^{-3}$ mole/g resin.

Preparation of
Poly(divinylbenzene-co-trihexylammoniomethylstyrene chloride-co-tributylammoniomethylstyrene chloride) (Compound 49)

20 g of poly(divinylbenzene-co-chloromethylstyrene) spherical particles were introduced into a 500 ml 3-necked flask equipped with a stirrer, a thermometer and a cooling tube, and 70 g of isopropyl alcohol, 30 g of dimethylformamide and 40 g tributylamine were added thereto to swell the resin at room temperature for 30 min. with stirring. The reaction system was heated to 80° C. and the reaction was continued for 6 hr. with refluxing the solvent. Then, the reaction system was cooled to room temperature, the resulting solid contents was filtered off, followed by adding 40 g of 30% aqueous trimethylamine solution, reacting at room temperature for 2hr., raising the temperature to 80° C. by heating for one hour and filtering off the resin particles in the system. The spherical resin was sufficiently washed with running warm water of 50° C., ultrasonic washing was performed for every 30 min. using 2 l each of methanol, acetone, ethyl acetate and acetone in this order and the resin was dried at 120° C. under a reduced pressure to obtain 30.0 g of spherical resin particles. The chloride ion content thereof was $3.1\times10^{-3}$ (mole/g resin).

The chloride ion content was determined by swelling the ground resin in 1N sodium nitrate solution and titrating the solution with 0.1N silver nitrate.

PREPARATION EXAMPLE 6

Preparation of
Poly(divinylbenzene-co-trihexylammoniomethylstyrene chloride-co-chloromethylstyrene)

There were introduced, at room temperature, 360 g of water and 168.9 g (0.40 mole) of N-vinylbenzyl-N,N,N-trihexylammonium chloride to let sufficiently absorb water to thus obtain an oily substance. To the oily substance, there were added 5.2 g (0.04 mole) of divinylbenzene, 9.2 g (0.06 mole) of chloromethylstyrene and 4.0 g of benzoyl peroxide and further a solution of 1350 g of calcium chloride in 1,000 g of water and a solution of 2.9 g of polyvinyl alcohol (the same as that used above) in 440 g of water, with stirring. The solution was stirred at room temperature, at 150 rpm in a nitrogen gas stream for 30 min., then heated to 70° C. and further stirred for 6 hr.

The solution was cooled down to room temperature, the resulting solid contents were filtered off and were subjected to ultrasonic washing for 30 min. of 2 l of distilled water maintained at 50° C. Then, the washing was repeated using, as solvents, 2 l each of methanol, acetone and ethyl acetate and the solid was dried at 100° C. under a reduced pressure to obtain 176.8 g of spherical resin particles (chloride ion content: $2.1\times10^{-3}$ mole/g resin).

Preparation of
Poly(divinylbenzene-co-trimethylammoniomethylstyrene chloride-co-trihexylammoniomethylstyrene) (Compound 48)

150 g of the poly(divinylbenzene-co-trihexylammoniomethylchloride-co-chloromethylstyrene) obtained above was introduced into a 2 l 3-necked flask equipped with a stirrer, a thermometer and a cooling tube and 300 ml of dichloroethane was added thereto at room temperature to swell the resin for 30 min. Then, 500 ml of 30% aqueous trimethylamine solution was added, followed by allowing to stand for one hour to swell and reacting at room temperature for 2 hr. with stirring. Thereafter, the system was heated to 80° C. to get out dichloroethane from the system by azeotropy. 500 ml of water was added in three portions during heating to prevent drying of the resin. After continuing the removal of the solvent until dichloroethane was not distilled by azeotropy, the resultant solid contents were filtered off and washed with running water sufficiently. Then, the solid was subjected to ultrasonic washing in 3 l of warm water of 50° C. for 30 min., followed by repeating the washing using 2 l each of methanol, acetone, ethyl acetate and acetone for every 30 min. and drying the solid at 120° C. under reduced pressure to obtain 147.2 g of spherical resin particles. The chloride ion content thereof was $3.0\times10^{-3}$ (mole/g).

In the general formula (VIII), G preferably represents

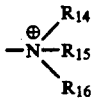

from the viewpoint of selective removal of iodide ions and more preferably G represents such a functional group wherein the total carbon atom number of R14 to R16 is not less than 12. Specifically, preferred are Compounds (3) to (5), (12), (19), (20), (23), (24), (28), (29), (32), and (44) to (49).

In the method of this invention, the bleaching process is performed while a part or whole of a bleaching solution is brought into contact with an anion-exchange resin. The contact between the bleaching solution and the anion-exchange resin can be carried out by, for instance, packing an anion-exchange resin in a column and incorporating it into a circulating pump of a fixing bath (e.g., a bleaching or bleach-fixing bath); or charging it into a subtank separately disposed and continuously or intermittently circulating a fixing solution from the fixing bath to the subtank. Alternatively, the contact can be performed by a method comprising packaging an anion-exchange resin in a bag of fine mesh net and immersing the same in the bath for fixing.

In the present invention, the processing solution for fixing (processing solution having fixing ability includes fixing solutions and bleach-fixing solutions, particularly it is preferably a bleach-fixing solution.

The method may be a continuous or batchwise one, preferably a continuous method. In particular, a continuous processing using an automatic developing machine to easily process a large amount of light-sensitive materials.

The continuous processing herein means a processing in which a processing solution is supplemented while the processing is continuously or intermittently performed for a long time period. The amount of the processing solution (replenisher) is determined depending on, for instance, area of the light-sensitive materials to be processed and processing time.

In addition, the method can be applied to a so-called regeneration system in which a solution obtained by bringing the overflow (fixing processing solution) from a fixing bath into contact with an anion-exchange resin is reused as a replenisher.

In addition, the present invention can be applied to so-called batch system in which a certain amount of light-sensitive material is processed with a constant amount of a processing solution without replenishment. In this case, the processing solution can be in contact with an anion-exchange resin during fixing process by, for instance, immersing the resin in the fixing processing solution.

The amount of the processing solution having fixing ability (fixing processing solution) to be brought into contact with the anion-exchange resins is 20 to 2000 liters and preferably 20 to 1000 liters per liter of the anion-exchange resins.

"The amount of the processing solution per liter of the anion-exchange resin" herein means the cumulative amount of the fixing processing solution supplemented during a continuous processing of light-sensitive materials per liter of the resin and if a replenisher is supplemented in the amount defined above, the resin should be replaced with a fresh one.

In the case of a batch system, the amount of a fixing processing solution per liter of a resin which is brought into contact with the resin, means the cumulative amount of the solution used until the resin is exchanged. For instance, if 10 l of the processing solution per batch is used, the resin is replaced with a new one after at least two batches (20 l of the solution) are contact therewith. In a batch system, the amount of the fixing processing solution to be in contact with the resin preferably ranges from 20 to 200 l.

In a usual processing, about 10 to 2,000 $m^2$ of light-sensitive materials are processed with about 5 to 20 l of the processing solution. Moreover, the amount of the processing solution to be replenished varies depending on the kinds of light-sensitive materials and processing solutions and their formulations, but it preferably ranges from about 50 to 2,000 ml, more preferably about 100 to 500 ml per 1$m^2$ of the light-sensitive material.

In general, supplementation of the fixing and bleach-fixing solutions is performed depending on area of the light-sensitive materials to be processed, but if the amount of the replenisher is saved, the rate of fixing is lowered because of the accumulation of substances dissolved out from the light-sensitive materials, as a result, the rate of desilvering is lowered and if the processing time is constant, insufficient fixing, i.e., insufficient desilvering is caused. However, in the method of this invention, such delay in fixing can be prevented since the foregoing processing with an anion-exchange resin is performed and a replenisher-saved and rapid processing can be achieved.

The light-sensitive materials to be processed by the method of this invention includes emulsion layers containing the aforesaid silver iodide. Other constructions thereof will be described below.

Treatment of Emulsion Layer and General Additives

The silver halide emulsions as used herein are subjected to physical and/or chemical ripening and are spectrally sensitized. Additives used in such processes are disclosed in Research Disclosure (RD), Vol. 176, No. 17643 (December, 1978) and ibid, Vol. 187, No. 18716 (November, 1979). The relevant passages are summarized in the following Table.

Photographic additives usable in the invention are also disclosed in the same articles (two Research Disclosures) and likewise the relevant passages are listed in the following Table.

| Kind of Additive | RD 17643 | RD 18716 |
|---|---|---|
| 1. Chemical Sensitizer | p. 23 | p. 648, right column |
| 2. Sensitivity Enhancing Agent | | p. 648, right column |
| 3. Spectral Sensitizing Agent | p. 23–24 | infra p. 648, right column |
| 4. Supersensitizing Agent | | p. 649, right column |
| 5. Brightener | p. 24 | |
| 6. Antifoggant & Stabilizer | p. 24–25 | p. 649, right column |
| 7. Coupler | p. 25 | |
| 8. Organic Solvent | " | |
| 9. Light Absorber, Filter Dye & Ultraviolet Absorber | p. 25–26 | p. 649, right to p. 650 left column |
| 10. Stain Resistant Agent | p. 25, right column | p. 650, left to right column |
| 11. Dye Image Stabilizer | p. 25 | |
| 12. Film Hardening Agent | p. 26 | p. 651, left column |
| 13. Binder | p. 26 | p. 651, left column |
| 14. Plasticizer & Lubricant | p. 27 | p. 650, right column |
| 15. Coating Aid & Surfactant | p. 26–27 | p. 650, right column |
| 16. Antistatic Agent | p. 27 | p. 650, right column |

Color Couplers

The color light-sensitive materials to be processed in the present invention may contain a color coupler. "Color coupler(s)" herein means a compound capable of forming a dye through coupling reaction with an oxidized form of an aromatic primary amine developing agent. Typical examples of useful color couplers are napthol or phenol type compounds, pyrazolone or pyrazoloazole type compounds, and linear or heterocyclic ketomethylene compounds. Cyan, magenta and yellow color couplers which may be used in the present invention are disclosed in the patents cited in Research Disclosure No. 17643 (December, 1978) VII-D; and ibid No. 18717 (November, 1979).

The color couplers to be incorporated into the light-sensitive materials are preferably made non-diffusible by imparting thereto ballast groups or polymerizing them. 2-Equivalent couplers which are substituted with coupling elimination groups are more preferable than 4-equivalent couplers in which a hydrogen atom is in a coupling active site, because the amount of coated silver can be decreased. Furthermore, couplers in which a formed dye has a proper diffusibility, non-color couplers, DIR couplers which release a development inhibitor through coupling reaction or couplers which release a development accelerator during coupling reaction may also be used.

Magenta couplers usable in the present invention include couplers of an oil protect type of indazolone, cyanoacetyl, or preferably pyrazoloazole such as 5-pyrazolone and pyrazolotriazol type ones. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896 and 3,936,015. An elimination group of the 2-equivalent 5-pyrazolone type couplers is preferably a nitrogen atom elimination group described in U.S. Pat. No. 4,310,619 and an arylthio group described in U.S. Pat. No. 4,351,897. The 5-pyrazolone type coupler having ballast groups described in European Patent No. 73,636 provide high color density.

As examples of pyrazoloazole type couplers, there may be named pyrazolobenzimidazoles described in U.S. Pat. No. 3,369,879, preferably pyrazole(5,1-c) (1,2,4) triazoles described in U.S. Pat. No. 3,725,067, pyrazolotetrazoles described in Research Disclosure No. 24230 (June, 1984) and pyrazolopyrazoles described in European Pat. No. 119,741 is preferred on account of small yellow minor absorption of formed dye and light fastness. Pyrazole(1,5-b) (1,2,4)triazole described in European Patent No. 119,860 is particularly preferred.

Cyan couplers which may be used in the present invention include naphthol or phenol type couplers of an oil protect type. Typical naphthol type couplers are disclosed in U.S. Pat. No. 2,474,293. Typical preferred 2-equivalent naphtholic couplers of oxygen atom elimination type are disclosed in U.S. Pat. Nos. 4,052,212; 4,146,396; 4,228,233; and 4,296,200. Exemplary phenol type couplers are disclosed in U.S. Pat. Nos. 2,369,929; 2,801,171; 2,772,162 and 2,895,826. Cyan couplers which are resistant to humidity and heat are preferably used in the present invention. Examples thereof are phenol type cyan couplers having an alkyl group having not less than two carbon atoms at a metha-position of a phenolic nucleus as disclosed in U.S. Pat. No. 3,772,002; 2,5-diacylamino substituted phenol type couplers as disclosed in U.S. Pat. Nos. 2,772,162; 3,758,308; 4,126,396; 4,334,011 and 4,327,173; DEOS No. 3,329,729; and Japanese Patent Application Serial (hereunder referred to as "J.P.A.") No. 58-42671; and phenol type couplers having a phenylureido group at the 2-position and an acylamino group at the 5-position as disclosed in U.S. Pat. Nos. 3,446,622; 4,333,999; 4,451,559; and 4,427,767.

A typical yellow coupler capable of being used in the present invention is an acylacetamide coupler of an oil protect type. Examples of these are disclosed in U.S. Pat. Nos. 2,407,210; 2,875,057; and 3,265,506. 2-Equivalent yellow couplers are preferably used in the present invention. Typical examples thereof include the yellow couplers of an oxygen atom elimination type disclosed in U.S. Pat. Nos. 3,408,194; 3,447,928; 3,933,501 and 4,022,620, or the yellow couplers of a nitrogen atom elimination type disclosed in J.P. KOKOKU No. 55-10739; U.S. Pat. Nos. 4,401,752; and 4,326,024, Research Disclosure No. 18053 (April, 1979), U.K. Patent No. 1,425,020, DEOS Nos. 2,219,917; 2,261,361; 2,329,587 and 2,433,812. Alpha-pivaloyl acetanilide type couplers are excellent in fastness, particularly light fastness, of the formed dye. α-benzoyl acetanilide type couplers yield high color density.

Graininess may be improved by using together a coupler which can form a dye moderately diffusible. As such dye-diffusing couplers, some magenta couplers are specifically described in U.S. Pat. No. 4,366,237 and U.K. Patent No. 2,125,570 and some yellow, magenta and cyan couplers are specifically described in European Patent No. 96,570 and DEOS No. 3,234,533.

Dye-forming couplers and the aforesaid special couplers may be a dimer or a higher polymer. Typical examples of polymerized dye-forming couplers are described in U.S. Pat. Nos. 3,451,820 and 4,080,211. Examples of polymerized magenta couplers are described in U.K. Patent No. 2,102,173 and U.S. Pat. No. 4,367,282.

In order to meet properties required for light-sensitive materials, two or more couplers may be used together in a single light-sensitive layer, or the same coupler may be introduced in two or more different light-sensitive layers.

The standard amount of the color couplers to be used is 0.001 to 1 mole and preferred amount thereof is 0.01 to 0.5 mole for yellow couplers, 0.003 to 0.3 mole for magenta couplers and 0.002 to 0.3 mole for cyan couplers per mole of light-sensitive silver halide.

The couplers used in the invention can be introduced into the color light-sensitive materials by a variety of known methods for dispersion. Examples of high boiling point organic solvents used in the oil-in-water dispersion method are disclosed in U.S. Pat. No. 2,322,027. Specific examples of processes, effects and latexes for impregnation, for latex dispersion method are, for instance, disclosed in U.S. Pat. No. 4,199,363 and DE OLS Nos. 2,541,274 and 2,541,230.

SUBSTRATE

The photographic light-sensitive materials to be processed by the present invention are applied to the surface of a flexible substrate such as a plastic film (e.g., cellulose nitrate, cellulose acetate or polyethylene terephthalate) or paper; or a rigid substrate such as a glass plate. Substrates and methods for applying the photographic light-sensitive materials thereto are detailed in Research Disclosure, vol. 176, No. 17643, Item XV (p. 27) and XVII (p. 28) (December, 1978).

Typical examples of the photographic light-sensitive materials to be processed by the method of the present invention include color negative film for general use or motion picture, color reversal films for slide or television, color paper, color positive films, color reversal paper, direct positive color light-sensitive materials, monochromatic films, monocromatic paper x-ray films and light-sensitive materials for printing.

DEVELOPMENT PROCESSING

The method of this invention comprises a variety of combination of the processing processes and specific examples thereof are as follows:

(i) Development - Bleaching - fixing - Water Washing - Drying (ii) Development - Bleaching - fixing - Water Washing - Stabilization - Drying
(iii) Development - Bleaching - fixing - Stabilization - Drying
(iv) Development - Bleach-fixing - Stabilization - Drying
(v) Developemnt - Bleach-fixing - Stabilization - Drying
(vi) Development - Bleach-fixing - Water Washing - Stabilization-Drying
(vii) Development - Bleaching - Bleach-fixing - Water Washing - Drying
(viii) Development - Bleaching - Bleach-fixing - Water Washing - Stabilization - Drying In this respect, it is also possible in the foregoing processes, to carry out water washing process between the development and bleaching or bleach-fixing processes; or between the bleaching and fixing processes. Each processing may be performed according to any manners such as a single bath processing, a multistage countercurrent system or multistage direct flow system. The foregoing development processing may comprise reversal color development process. For instance, it comprises monochromatic development - water washing - reversal -color development processes.

Development

The color developer used to develop the light-sensitive materials is preferably an aqueous alkaline solution containing, as a principal component, an aromatic primary amine type color developing agent. Although aminophenol type developing agents are also useful as the color developing agent, but preferred are p-phenylenediamine type compounds whose typical examples are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxyethylaniline and sulfates, hydrochlorides or p-toluenesulfonates thereof. These diamines in the form of salts are in general more stable than those in the free state and, therefore, they are preferably used in the form of salts.

The color developer in general contains pH buffering agents such as carbonates, borates or phosphates or alkali metals; development inhibitors such as bromides, iodides, benzimidazoles, benzothiazoles or mercapto compounds; or antifoggants. The color developer may further comprise, according to need, various kinds of preservatives such as hydroxylamine, diethylhydroxylamine, sulfites and compounds disclosed in J.P.A. No. 61-280792; organic solvents such as triethanolamine and diethylene glycol; development accelerators such as benzyl alcohol, polyethylene glycol, quaternary ammonium salts and amines; fogging agents such as dye-forming couplers, competing couplers and sodium borohydride; auxiliary developing agents such as 1-phenyl-3-pyrazolidone; thickening agents; a variety of chelating agents such as aminopolycarboxylic acid, aminopolyphosphonic acid, alkylphosphonic acid and phosphonocarboxylic acid; and anti-oxidizing agents as disclosed in DE OLS No. 2,622,950.

In addition, if the reversal processing is performed, the photographic light-sensitive materials are in general subjected to monochromatic development prior to the color development. In such a monochromatic developer, there may be used any known monochromatic developing agents, for instance, dihydroxybenzenes such as hydroquinone; 3-pyrazolidones such as 1-phenyl-3-pyrazolidone; and aminophenols such as N-methyl-p-aminophenol, which may be used alone or in combination.

The amount of the color developer and the monochromatic developer to be replenished generally varies depending on the kinds of the color photographic light-sensitive materials to be processed and it is in general not more than 3 liters per 1 $m^2$ of the light-sensitive material to be processed. However, it can be reduced to not more than 500 ml by reducing the amount of bromide ions present in the replenisher therefor. When the amount of the replenisher is reduced, the area of the opening of the processing bath should be limited to a small value to prevent the evaporation of the solution and the oxidation thereof with air. Alternatively, the amount of the replenisher may be reduced by utilizing a means for suppressing the accommodation of the bromide ions in the developer.

Bleaching, Fixing

Subsequently, the color developed photographic emulsion layer is generally processed with a bleach-fixing solution. The bleaching treatment and the fixing treatment may be performed separately or simultaneously. In this respect, the developed light-sensitive materials may be first bleached and then bleach-fixed for the purpose of achieving a rapid processing. It may be fixed prior to the bleach-fixing treatment or it may be bleach-fixed and then bleached according to purposes.

As the bleaching agents, there may be used, for instance, compounds of polyvalent metals such as iron(III), cobalt(III), chromium(IV) and copper(II); peracids; quinones; and nitroso compounds. Typical examples thereof include ferricyanides; bichromates; organic complexes of iron(III) or cobalt(III), such as complexed of organic acids, e.g., aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid and glycol ether diaminetetraacetic acid and organic acids such as citric acid, tartaric acid or malic acid; persulfates; hydrobromides; manganates; and nitrosophenol. Among these, ferric aminopolycarboxylates such as ferric ethylenediaminetetraacetate and persulfates are preferably used on account of rapid processing and prevention of environmental pollution. In addition, ferric complexes of aminopolycarboxylic acid are particularly preferred in both separate bleaching solutions and bleach-fixing solutions in one bath.

Examples of fixing agents are thiosulfates, thiocyanates, thioether type compounds, thioureas and a large amount of iodides, but in general thiosulfates sulfates are used and particularly ammonium thiosulfate is most widely used. Preferred preservatives for the bleach-fixing solution and the fixing solution are sulfites, bisulfites and carbonylbisulfite adducts.

Among the aforementioned processing solutions used in the desilvering process, the amount of the processing solution having fixing ability to be replenished is preferably not less than 50 to 2000 ml per 1 $m^2$ of the processed light-sensitive material and more preferably 100 to 500 ml.

WATER WASHING AND STABILIZATION

It is common that the silver halide color photographic light-sensitive materials to be processed by the present invention are subjected to water washing and/or stabilization processes after the desilvering process.

The amount of washing water in water washing process can widely be established depending on a variety of conditions such as characteristics of the light-sensitive materials to be processed (for instance, materials used such as couplers), applications, the temperature of the washing water, the number of washing tanks (step number), and the manners of the replenishment, for instance, direct flow system and countercurrent flow system. Among these, the relation between the amount of water and the number of water washing tanks in the multistage countercurrent flow system can be obtained by the method disclosed in Journal of the Society of Motion Picture and Television Engineers, 1955, May, Vol. 64, p. 248–253.

Although, the multistage countercurrent flow system disclosed in the foregoing article makes it possible to extremely reduce the amount of washing water, the retention time of water in the tanks increases and as a result bacteria proliferates therein which leads to the formulation of floating substances and the adhesion of the substances to the processed light-sensitive materials.

In order to solve such problems in the processing of color light-sensitive materials, a method for reducing the amount of calcium and magnesium, in washing water and/or the replenisher therefor disclosed in J.P.A. No. 61-131632 can be effectively adopted in the invention. Alternatively, the problems can also be solved by utilizing isothiazolone compounds and thiabendazoles disclosed in J.P. KOKAI No. 57-8542; such chlorine type antibacterial agents as sodium chlorinated isocyanurates; or other antibacterial agents as sodium benzotriazoles disclosed in "BOKIN BOBSIZAI NO KAGAKU (Chemistry of Antibacterial and Antifungus Agents)", Hiroshi HORIGUCHI; "BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus Agents", edited by Japan Bacteria and Fungi Controlling Society.

In the present invention, the pH value of the washing water is 4 to 9 and preferably 5 to 8. The temperature and time of the water washing process may vary depending on, for instance, the properties and applications of the light-sensitive materials to be processed, but in general the water washing is performed at a temperature of 15° to 45° C. for 20 seconds to 10 minutes and preferably 25° to 40° C. for 30 seconds to 5 minutes.

In the invention, the light-sensitive materials are directly processed with a stabilization solution instead of the water washing process. In such a stabilization process, andy known methods disclosed in J.P. KOKAI Nos. 57-8453, 58-14834 and 60-220345 can be employed.

Additionally, the stabilization process may be carried out subsequent to the water washing process and examples thereof are stabilization baths containing formalin and a surfactant, which is used as the final bath for processing color light-sensitive materials for taking photographs. The stabilization solution may also contain a variety of chelating agents and/or antifungus agents.

The overflow associated with the supplementation of a replenisher to the water washing and/or stabilization processes may be introduced into other baths such as those for the desilvering process to reuse them.

The silver halide color light-sensitive materials processed by the invention may contain a developing agent for simplification of processes and rapid processing. For that purpose, it is preferable to use a variety of precursors of the color developing agents. Examples thereof include indoaniline compounds as disclosed in U.S. Pat. No. 3,342,597; Schiff base type compounds as disclosed in U.S. Pat. No. 3.342,599 and Research Disclosure Nos. 14850 and 15159; aldol compounds as disclosed in Research Disclosure No. 13924; metal complex salts as disclosed in U.S. Pat. No. 3,719,492; and urethane type compounds as disclosed in J.P. KOKAI No. 53-135628.

For the purpose of promoting color development, the silver halide color light-sensitive materials processed by the invention may optionally comprise various 1-phenyl-3-pyrazolidones. Typical examples of such compounds are disclosed in, for instance, J.P. KOKAI Nos. 56-64339; 57-14454 and 58-115438.

In the present invention, each processing solution is used at a temperature of 10° to 50° C. It generally ranges for 33° to 38° C., but higher temperature may be used to promote the processing and to thus reduce the processing time, or a lower temperature may also be used to improve the quality of images or the stability of the processing solution. Moreover, to save the amount of silver in the color light-sensitive materials, processings utilizing cobalt intensifier or hydrogen peroxide intensifier disclosed in German Patent No. 2,226,770 and U.S. Pat. No. 3,674,499 can be employed.

Each processing bath may be provided with a heater, a temperature sensor, a level sensor, a circulation pump, a filter, a floating cover, a squeezy and the like according to need.

Moreover, if a continuous processing is performed, the composition of each processing solution should be maintained by adding a replenisher for each processing solution to achieve uniform finishing of the processed materials. The amount of the replenisher can be reduced to half or less of the standard replenished amount for cutting the cost.

EXAMPLE

The present invention will hereunder be explained in more detail with reference to the following Examples, but the present invention is not restricted to these Examples.

Example 1

A multi-layered color light-sensitive material (Sample 101) was prepared by applying in order coating solutions having the following compositions on the surface of a substrate of cellulose triacetate to which an underlying layer had been applied.

(Composition of the Light-sensitive Layer)

In the following composition, the coated amounts are expressed in g/m$^2$ of elemental silver for silver halide and colloidal silver; in g/m$^2$ for couplers, additives and gelating; and in moles per mole of silver halide included in the same layer for sensitizing dyes.

| 1st Layer: Halation Inhibiting Layer | |
|---|---|
| Black colloidal silver | 0.2 |
| Gelatin | 1.3 |
| Coupler C-1 | 0.06 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |

| 2nd Layer: Intermediate Layer | |
|---|---|
| Fine grain silver bromide (average grain size = 0.07μ) | 0.15 |
| Gelatin | 1.0 |
| Coupler C-2 | 0.02 |
| Dispersion oil Oil-1 | 0.1 |

| 3rd Layer: First Red-sensitive Emulsion layer | |
|---|---|
| Silver iodobromide emulsion (AgI = 2 mole %; diameter/thickness ratio = 2.5; average grain size = 0.3μ; AgI content is high at the inner portion) | 0.4 (Ag) |
| Gelatin | 0.6 |
| Sensitizing dye I | $1.0 \times 10^{-4}$ |
| Sensitizing dye II | $3.0 \times 10^{-4}$ |
| Sensitizing dye III | $1 \times 10^{-5}$ |
| Coupler C-3 | 0.06 |
| Coupler C-4 | 0.06 |
| Coupler C-8 | 0.04 |
| Coupler C-2 | 0.03 |
| Dispersion oil Oil-1 | 0.03 |
| Dispersion oil Oil-3 | 0.012 |

| 4th Layer: Second Red-sensitive Emulsion Layer | |
|---|---|
| Silver iodobromide emulsion (AgI = 5 mole %; diameter/thickness ratio = 4.0; average grain size = 0.7μ; AgI content is high at the inner portion) | 0.7 (Ag) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersion oil Oil-1 | 0.15 |
| Dispersion oil Oil-3 | 0.02 |

| 5th Layer: Third Red-sensitive Emulsion Layer | |
|---|---|
| Silver iodobromide emulsion (AgI = 10 mole %; diameter/thickness ratio = 1.3; average grain size = 0.8μ; AgI content is high at the inner portion) | 1.0 (Ag) |
| Gelatin | 1.0 |
| Sensitizing dye I | $1 \times 10^{-4}$ |
| Sensitizing dye II | $3 \times 10^{-4}$ |
| Sensitizing dye III | $1 \times 10^{-5}$ |
| Coupler C-6 | 0.05 |
| Coupler C-7 | 0.1 |
| Dispersion oil Oil-1 | 0.01 |
| Dispersion oil Oil-2 | 0.05 |

| 6th Layer: Intermediate Layer | |
|---|---|
| Gelatin | 1.0 |
| Compound Cpd-A | 0.03 |
| Dispersion oil Oil-1 | 0.05 |

| 7th Layer: First Green-sensitive Emulsion Layer | |
|---|---|
| Silver iodobromide emulsion (AgI = 2 mole %; diameter/thickness ratio = 2.5; average grain size = 0.3μ; AgI content is high at the inner portion) | 0.3 (Ag) |
| Gelatin | 1.0 |

-continued

| 7th Layer: First Green-sensitive Emulsion Layer | |
|---|---|
| Sensitizing dye IV | $5 \times 10^{-4}$ |
| Sensitizing dye VI | $0.3 \times 10^{-4}$ |
| Sensitizing dye V | $2 \times 10^{-4}$ |
| Coupler C-9 | 0.2 |
| Coupler C-5 | 0.03 |
| Coupler C-1 | 0.03 |
| Compound Cpd-C | 0.012 |
| Dispersion oil Oil-1 | 0.5 |

| 8th Layer: Second Green-sensitive Emulsion Layer | |
|---|---|
| Silver iodobromide emulsion (AgI = 4 mole %; diameter/thickness ratio = 4.0; average grain size = 0.6μ; AgI content is high at the inner portion) | 0.4 (Ag) |
| Gelatin | 1.0 |
| Sensitizing dye IV | $5 \times 10^{-4}$ |
| Sensitizing dye V | $2 \times 10^{-4}$ |
| Sensitizing dye VI | $0.3 \times 10^{-4}$ |
| Coupler C-9 | 0.25 |
| Coupler C-1 | 0.03 |
| Coupler C-10 | 0.015 |
| Coupler C-5 | 0.01 |
| Compound Cpd-C | 0.012 |
| Dispersion oil Oil-1 | 0.2 |

| 9th layer: Third Green-sensitive Emulsion Layer | |
|---|---|
| Silver iodobromide emulsion (AgI = 6 mole %; diameter/thickness ratio = 1.2; average grain size = 1.0μ; AgI content is high at the inner portion) | 0.85 (Ag) |
| Gelatin | 1.0 |
| Sensitizing dye VII | $3.5 \times 10^{-4}$ |
| Sensitizing dye VIII | $1.4 \times 10^{-4}$ |
| Coupler C-13 | 0.01 |
| Coupler C-12 | 0.03 |
| Coupler C-9 | 0.20 |
| Coupler C-1 | 0.02 |
| Coupler C-15 | 0.02 |
| Dispersion oil Oil-1 | 0.20 |
| Dispersion oil Oil-2 | 0.05 |

| 10th Layer: Yellow Filter Layer | |
|---|---|
| Gelatin | 1.2 |
| Yellow colloidal silver | 0.08 |
| Compound Cpd-B | 0.1 |
| Dispersion oil Oil-1 | 0.3 |

| 11th Layer: First Blue-sensitive Emulsion Layer | |
|---|---|
| Monodisperse Silver iodobromide emulsion (AgI = 4 mole %; diameter/thickness ratio = 1.5; average grain size = 0.5μ; AgI content is high at the inner portion) | 0.4 (Ag) |
| Gelatin | 1.0 |
| Sensitizing dye IX | $2 \times 10^{-4}$ |
| Coupler C-14 | 0.9 |
| Coupler C-5 | 0.07 |
| Dispersion oil Oil-1 | 0.2 |

| 12th Layer: Second Blue-sensitive Emulsion Layer | |
|---|---|
| Silver iodobromide emulsion (AgI = 10 mole %; diameter/thickness ratio = 4.5; average grain size = 1.3μ; AgI content is high at the inner portion) | 0.4 (Ag) |

-continued

| 12th Layer: Second Blue-sensitive Emulsion Layer | |
|---|---|
| Gelatin | 0.6 |
| Sensitizing dye IX | $1 \times 10^{-4}$ |
| Coupler C-14 | 0.25 |
| Dispersion oil Oil-1 | 0.07 |

| 13th Layer: First Protective Layer | |
|---|---|
| Gelatin | 0.8 |
| Ultraviolet absorber UV-1 | 0.1 |
| Ultraviolet absorber UV-2 | 0.2 |
| Dispersion oil Oil-1 | 0.01 |
| Dispersion oil Oil-2 | 0.01 |

| 14th Layer: Second Protective Layer | |
|---|---|
| Fine grain silver bromide (average grain size = 0.07μ) | 0.5 |
| Gelatin | 0.45 |
| Polymethyl methacrylate particles (diameter = 15μ) | 0.2 |
| Film hardening agent H-1 | 0.4 |
| n-Butyl p-hydroxybenzoate | 0.012 |
| Formaldehyde scavenger S-1 | 0.5 |
| Formaldehyde scavenger S-2 | 0.5 |

To each layer there was added a surfactant as a coating aid in addition to the foregoing components.

The chemical structures or the chemical names of the compounds used in this Example are as follows:

UV-1

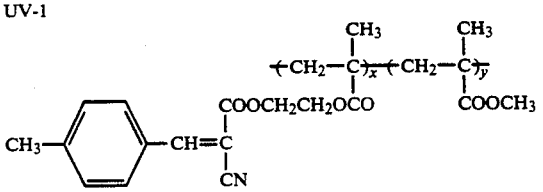

x/y = 7/3 (weight ratio)

UV-2

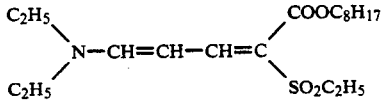

Oil-1
Tricresyl Phosphate

Oil-2
Dibutyl Phthalate

Oil-3
Bis(2-ethylhexyl)Phthalate

C-1

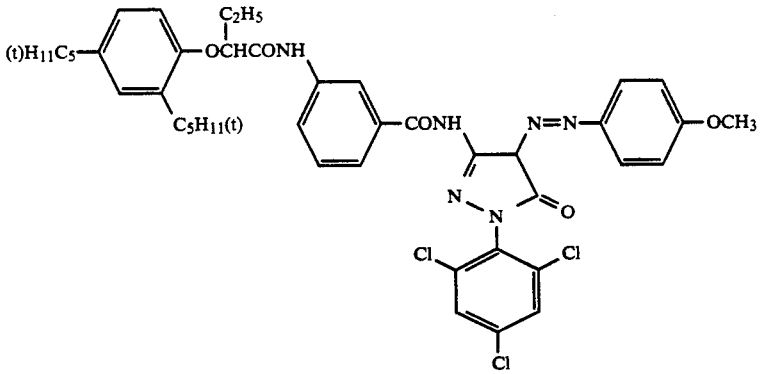

C-2

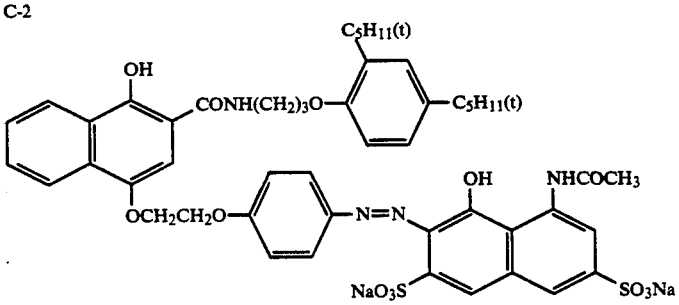

-continued
C-3
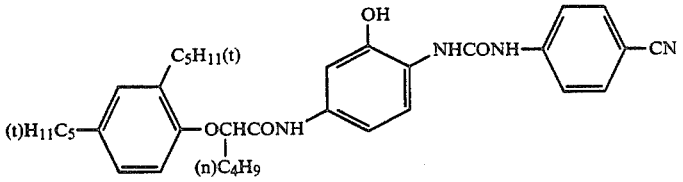
C-4
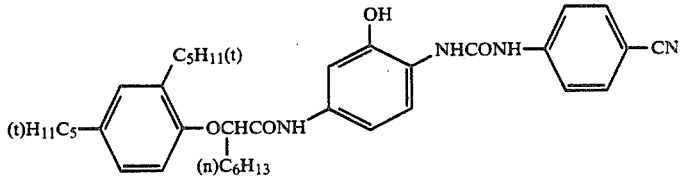
C-5
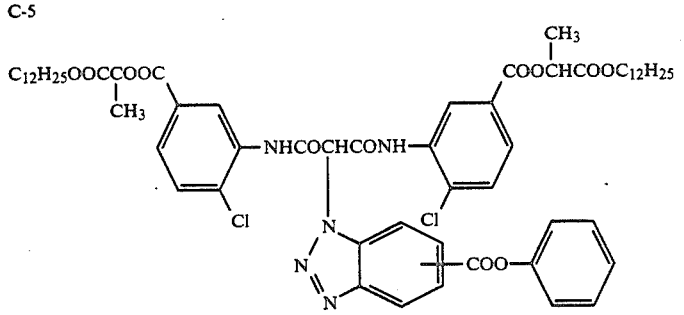
C-6
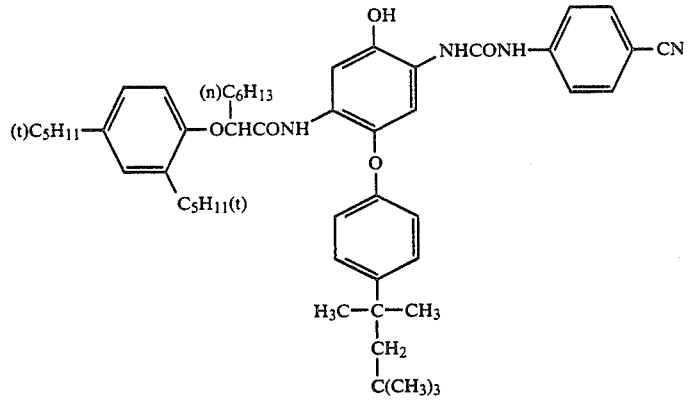
C-7
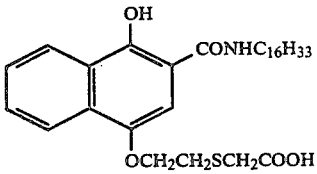
C-8
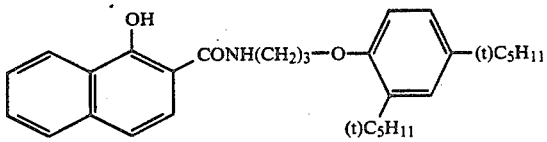
C-9

-continued
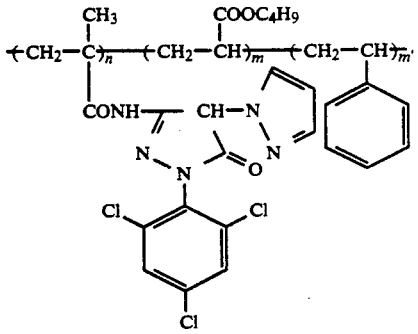
n = 55
m = 20
m' = 25
mol. wt. = about 20,000
C-10
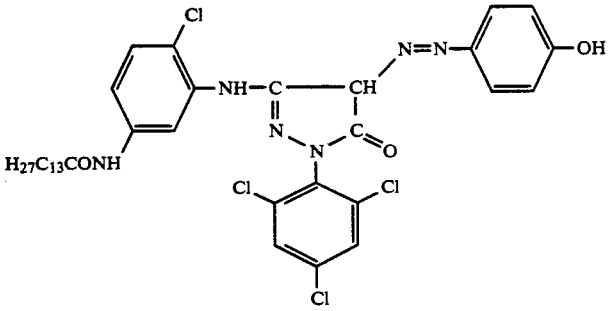
C-11
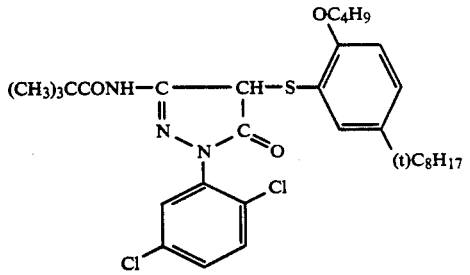
C-12
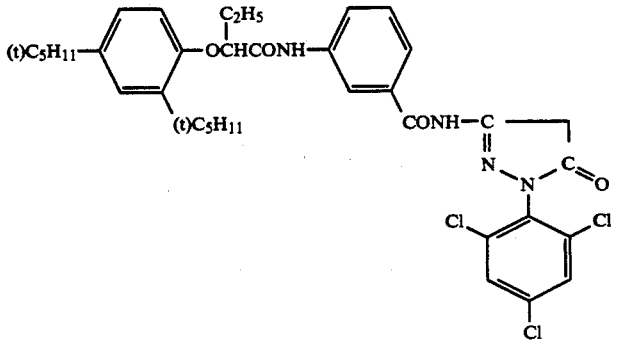
C-13

-continued
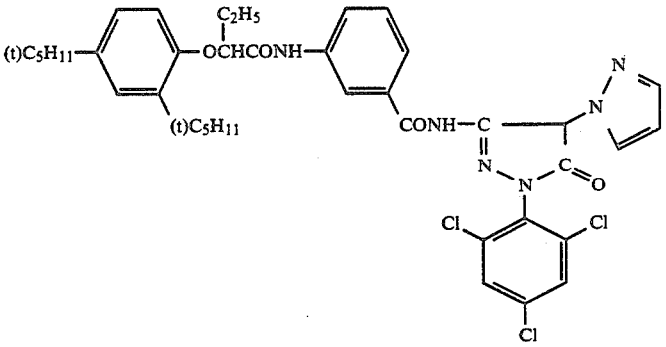
C-14
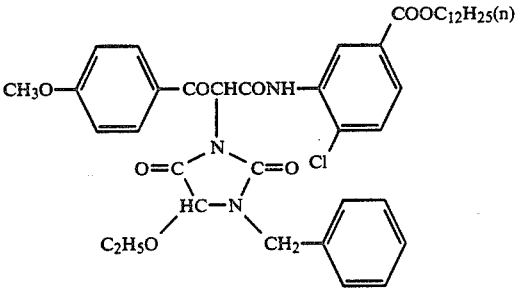
C-15
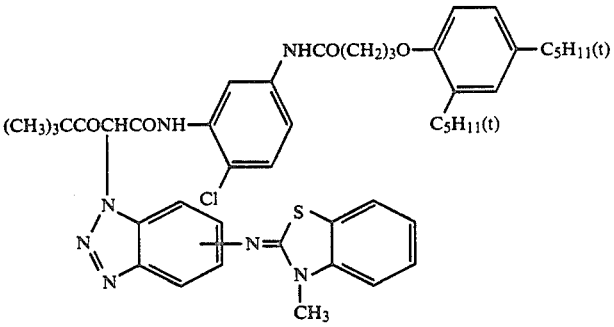
CpdA
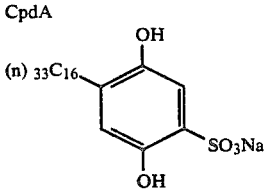
CpdB
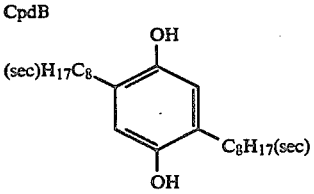
Cpd-C
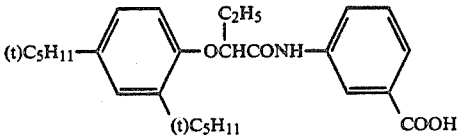
Sensitizing Dye I -continued
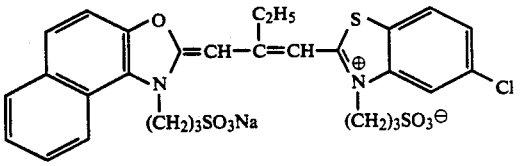
Sensitizing Dye II
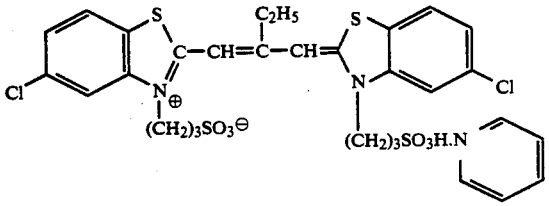
Sensitizing Dye III
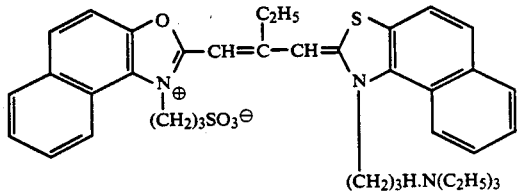
Sensitizing Dye IV
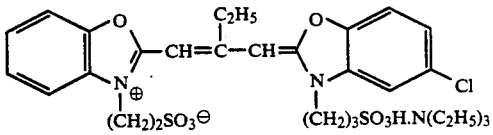
Sensitizing Dye V
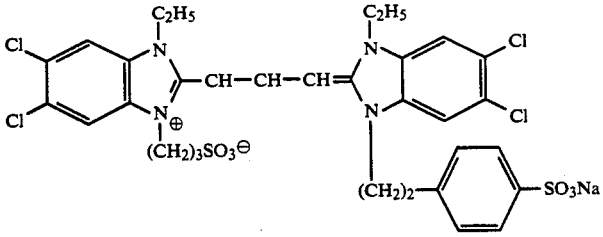
Sensitizing Dye VI
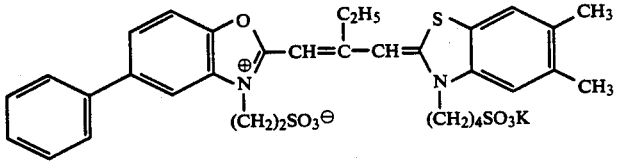
Sensitizing Dye VII
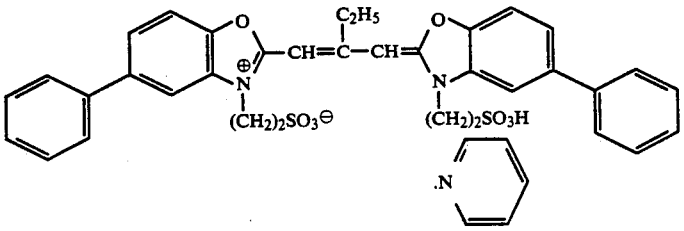
Sensitizing Dye VIII -continued

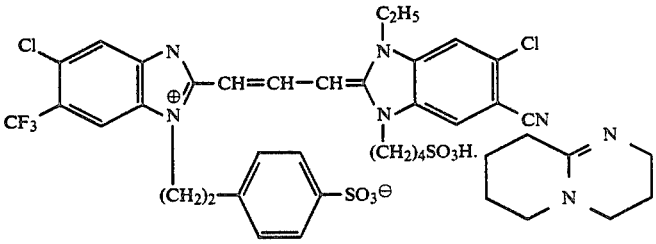

Sensitizing Dye IX

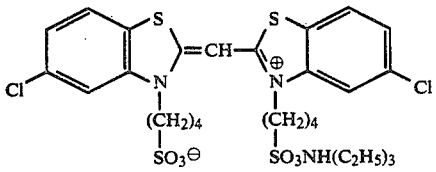

H-1

$CH_2{=}CH{-}SO_2{-}CH_2{-}CONH{-}CH_2$
$CH_2{=}CH{-}SO_2{-}CH_2{-}CONH{-}CH_2$

S-1

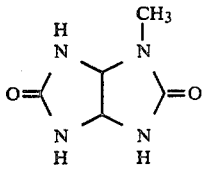

S-2

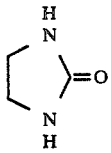

A multilayered color light-sensitive material (Sample 102) was prepared by applying in order coating solutions having the following compositions onto the surface of a substrate of cellulose triacetate to which an underlying layer had been applied.

(Composition of the Light-sensitive Layer)

In the following composition, the coated amounts are expressed in g/m$^2$, that of silver halide is expressed in the reduced amount of elemental silver. The coated amount of sensitizing dyes is expressed in moles per mole of silver halide included in the same layer.

| (Sample 102) 1st Layer: Halation Inhibiting Layer | |
|---|---|
| Black colloidal silver | 0.18 (Ag) |
| Gelatin | 0.40 |

| 2nd Layer: Intermediate Layer | |
|---|---|
| 2,5-Di-t-pentadecyl hydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |

-continued

| 2nd Layer: Intermediate Layer | |
|---|---|
| HBS-2 | 0.02 |
| Gelatin | 1.04 |

| 3rd Layer: First Red-sensitive Emulsion Layer | |
|---|---|
| Monodisperse silver iodobromide emulsion (AgI = 6 mole %; average grain size = 0.6μ; Coefficient of Variation in grain size (C.V.) = 0.15) | 0.55 (Ag) |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| Sensitizing dye IV | $4.0 \times 10^{-5}$ |
| EX-2 | 0.350 |
| HBS-1 | 0.005 |
| EX-10 | 0.020 |
| Gelatin | 1.20 |

| 4th Layer: Second Red-sensitive Emulsion Layer | |
|---|---|
| Tabular silver iodobromide emulsion (AgI = 10 mole %; average grain size = 0.7μ; average aspect ratio = 5.5; average thickness = 0.2μ) | 1.0 (Ag) |
| Sensitizing dye I | $5.1 \times 10^{-5}$ |
| Sensitizing dye II | $1.4 \times 10^{-5}$ |
| Sensitizing dye III | $2.3 \times 10^{-4}$ |

-continued

| 4th Layer: Second Red-sensitive Emulsion Layer | |
|---|---|
| Sensitizing dye IV | $3.0 \times 10^{-5}$ |
| EX-2 | 0.400 |
| EX-3 | 0.050 |
| EX-10 | 0.015 |
| Gelatin | 1.30 |

| 5th Layer: Third Red-sensitive Emulsion Layer | |
|---|---|
| Silver iodobromide emulsion (AgI = 16 mole %; average grain size = 1.1μ) | 1.60 (Ag) |
| Sensitizing dye IX | $5.4 \times 10^{-5}$ |
| Sensitizing dye II | $1.4 \times 10^{-5}$ |
| Sensitizing dye III | $2.4 \times 10^{-4}$ |
| Sensitizing dye IV | $3.1 \times 10^{-5}$ |
| EX-3 | 0.240 |
| EX-4 | 0.120 |
| HBS-1 | 0.22 |
| HBS-2 | 0.10 |
| Gelatin | 1.63 |

| 6th Layer: Intermediate Layer | |
|---|---|
| EX-5 | 0.040 |
| HBS-1 | 0.020 |
| EX-12 | 0.004 |
| Gelatin | 0.80 |

| 7th Layer: First Green-sensitive Emulsion Layer | |
|---|---|
| Tabular silver iodobromide emulsion (AgI = 6 mole %; average grain size = 0.6μ; average aspect ratio = 6.0; average thickness = 0.15μ) | 0.40 (Ag) |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| EX-6 | 0.260 |
| EX-1 | 0.021 |
| EX-7 | 0.030 |
| EX-8 | 0.025 |
| HBS-1 | 0.100 |
| HBS-4 | 0.010 |
| Gelatin | 0.75 |

| 8th Layer: Second Green-sensitive Emulsion Layer | |
|---|---|
| Monodisperse silver iodobromide emulsion (AgI = 9 mole %; average grain size = 0.7μ; Coefficient of Variation in grain size (C.V.) = 0.18) | 0.80 (Ag) |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| EX-6 | 0.180 |
| EX-8 | 0.010 |
| EX-1 | 0.008 |
| EX-7 | 0.012 |
| HBS-1 | 0.160 |
| HBS-4 | 0.008 |
| Gelatin | 1.10 |

| 9th Layer: Third Green-sensitive Emulsion Layer | |
|---|---|
| Silver iodobromide emulsion (AgI = 12 mole %; average grain size = 1.0μ) | 1.2 (Ag) |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| EX-6 | 0.065 |

-continued

| 9th Layer: Third Green-sensitive Emulsion Layer | |
|---|---|
| EX-11 | 0.030 |
| EX-1 | 0.025 |
| HBS-1 | 0.25 |
| HBS-2 | 0.10 |
| Gelatin | 1.74 |

| 10th Layer: Yellow Filter Layer | |
|---|---|
| Yellow colloidal silver | 0.05 (Ag) |
| EX-5 | 0.08 |
| HBS-3 | 0.03 |
| Gelatin | 0.95 |

| 11th Layer: First Blue-sensitive Emulsion Layer | |
|---|---|
| Tabular silver iodobromide emulsion (AgI = 6 mole %; average grain size = 0.6μ; average aspect ratio = 5.7; average thickness = 0.15μ) | 0.24 (Ag) |
| Sensitizing dye VIII | $3.5 \times 10^{-4}$ |
| EX-9 | 0.85 |
| EX-8 | 0.12 |
| HBS-1 | 0.28 |
| Gelatin | 1.28 |

| 12th Layer: Second Blue-sensitive Emulsion Layer | |
|---|---|
| Monodisperse silver iodobromide emulsion (AgI = 10 mole %; average grain size = 0.8μ; Coefficient of Variation in grain size (C.V.) = 0.16) | 0.45 (Ag) |
| Sensitizing dye VIII | $2.1 \times 10^{-4}$ |
| EX-9 | 0.20 |
| EX-10 | 0.015 |
| HBS-1 | 0.03 |
| Gelatin | 0.46 |

| 13th Layer: Third Blue-sensitive Emulsion Layer | |
|---|---|
| Silver iodobromide emulsion (AgI = 14 mole %; average grain size = 1.3μ) | 0.77 (Ag) |
| Sensitizing dye VIII | $2.2 \times 10^{-4}$ |
| EX-9 | 0.20 |
| HBS-1 | 0.07 |
| Gelatin | 0.69 |

| 14th Layer: First Protective Layer | |
|---|---|
| Silver iodobromide emulsion (AgI = 1 mole %; average grain size = 0.07μ) | 0.5 (Ag) |
| U-4 | 0.11 |
| U-5 | 0.17 |
| HBS-1 | 0.90 |
| Gelatin | 1.00 |

| 15th Layer: Second Protective Layer | |
|---|---|
| Polymethyl acrylate particles (diameter = about 1.5μ) | 0.54 |
| S-1 | 0.15 |
| S-2 | 0.05 |
| Gelatin | 0.72 |

To each layer, there were added, in addition to the foregoing components, a gelatin hardening agent-H-1 and a surfactant.
U-1
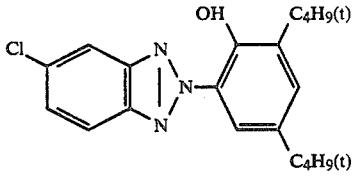
U-2
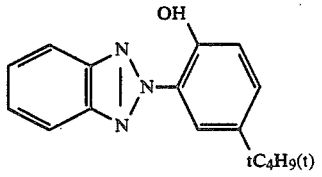
U-3
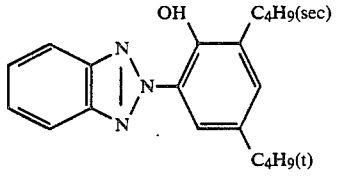
U-4
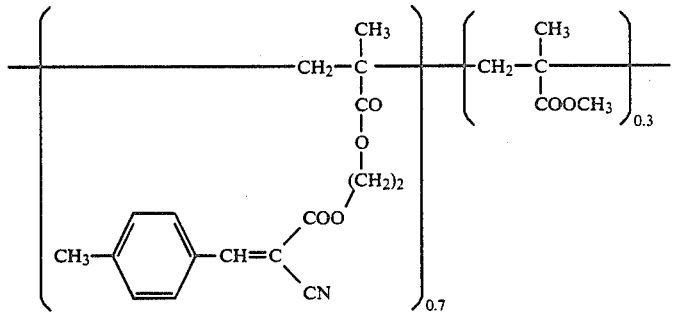
U-5
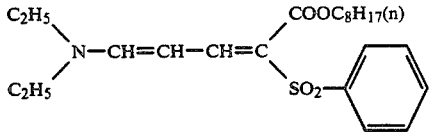
EX-1
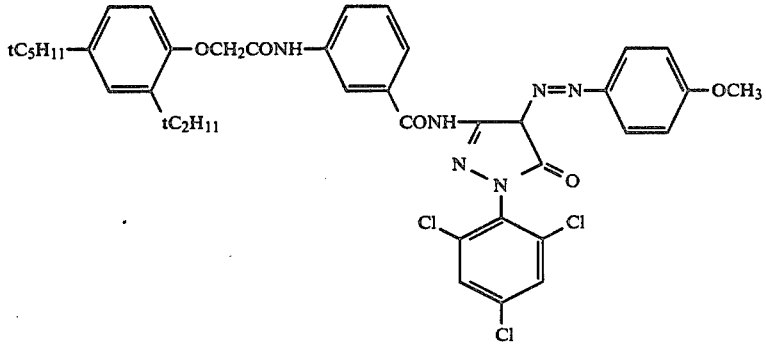
EX-2

-continued
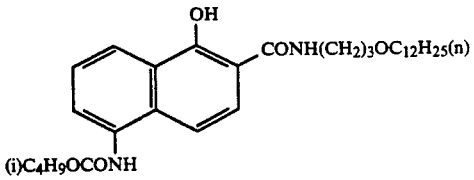
EX-3
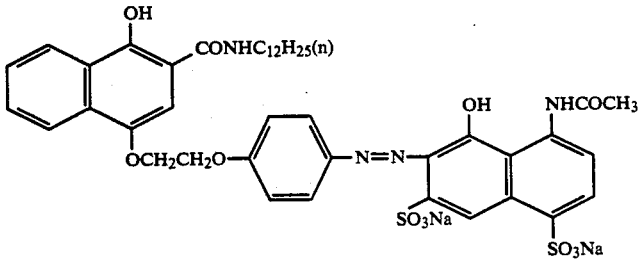
EX-4
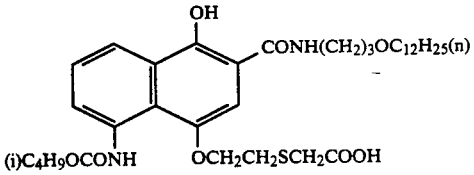
EX-5
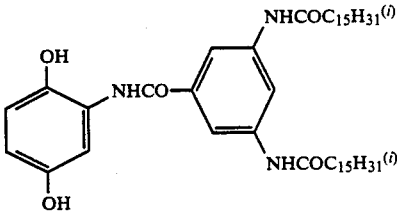
EX-6
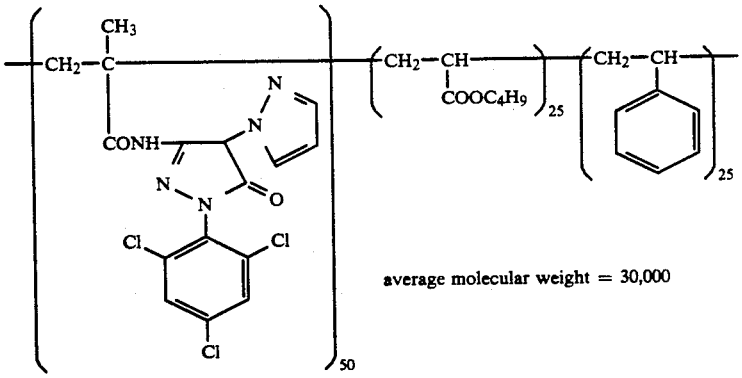
EX-7
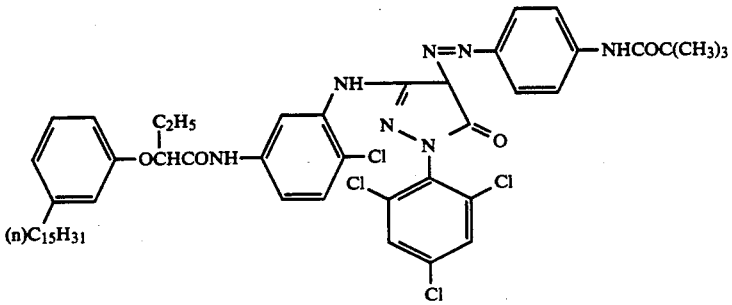

-continued
EX-8
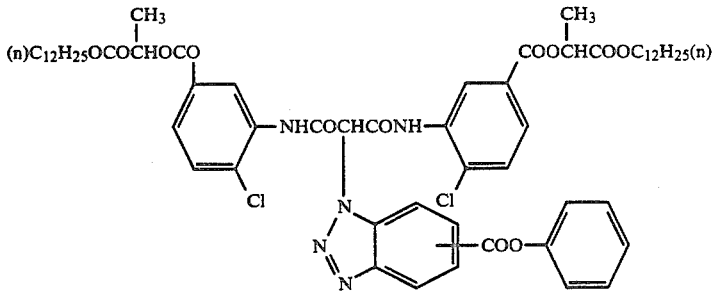
EX-9
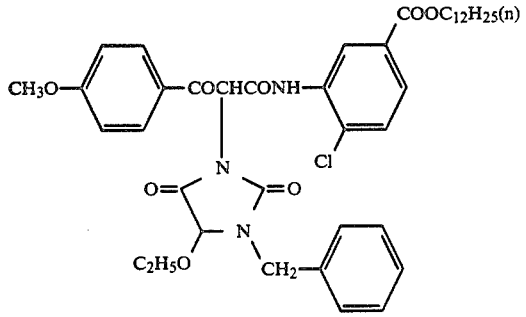
EX-10
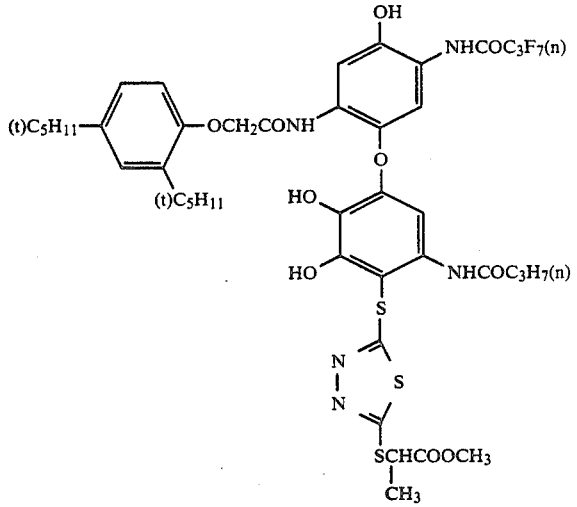
EX-11
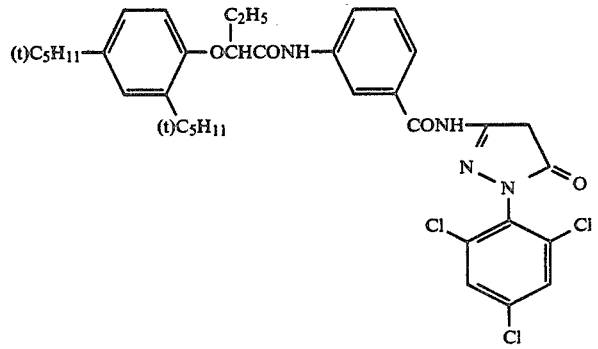
EX-12

-continued
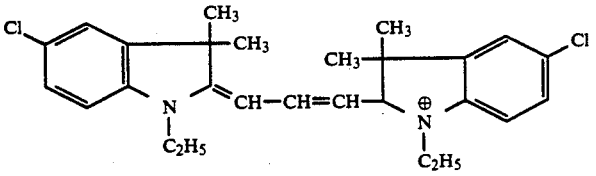
S-1
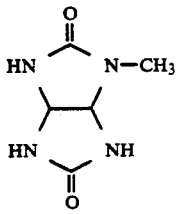
S-2
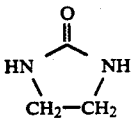
HBS-1 Tricresyl Phosphate
HBS-2 Dibutyl Phthalate
HBS-3 Bis(2-ethylhesyl)Phthalate
HBS-4
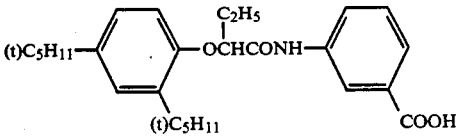
H-1
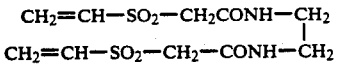
Sensitizing Dyes
I
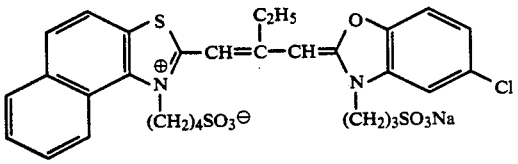
II
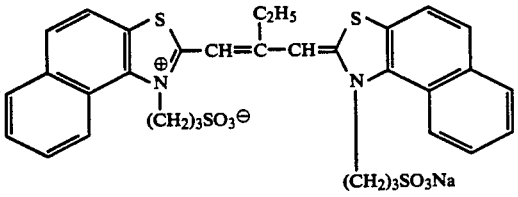
III
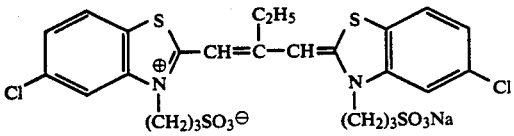
IV -continued

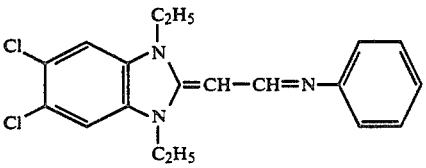

V

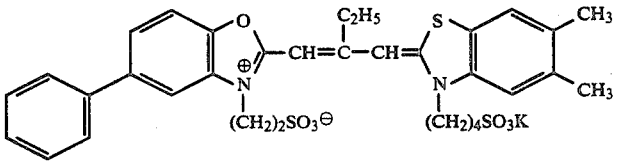

VI

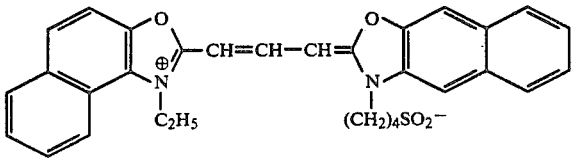

VII

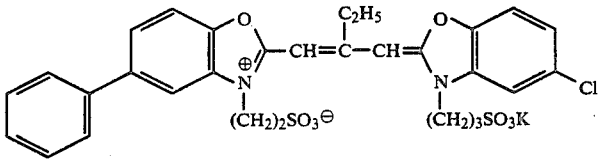

VIII

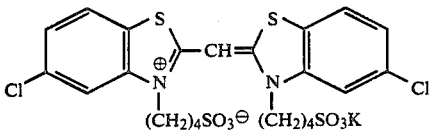

IX

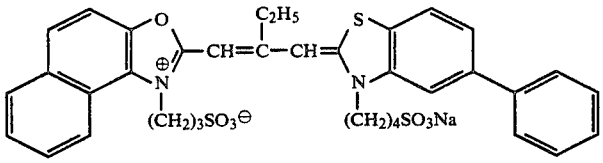

A multilayered color light-sensitive material (Sample 103) was prepared by applying in order coating solutions having the following compositions onto the surface of a substrate of cellulose triacetate film to which an underlying layer had been applied.

(Composition of the Light-sensitive Layer)

The coated amount of silver halide and colloidal silver is expressed in g/m$^2$ of elemental silver; those of couplers, additives and gelatin are expressed in g/m$^2$ and that of sensitizing dyes is expressed in moles per mole of silver halide included in the same layer.

| 1st Layer: Halation Inhibiting Layer | |
|---|---|
| Black colloidal silver | 0.2 |
| Gelatin | 1.3 |
| ExM-9 | 0.06 |
| UV-1 | 0.03 |
| UV-2 | 0.06 |
| UV-3 | 0.06 |

-continued

| 1st Layer: Halation Inhibiting Layer | |
|---|---|
| Solv-1 | 0.15 |
| Solv-2 | 0.15 |
| Solv-3 | 0.05 |

| 2nd Layer: Intermediate Layer | |
|---|---|
| Gelatin | 1.0 |
| UV-1 | 0.03 |
| ExC-4 | 0.02 |
| ExF-1 | 0.004 |
| Solv-1 | 0.1 |
| Solv-2 | 0.1 |

| 3rd Layer: Low sensitive Red-sensitive Emulsion Layer | |
|---|---|
| Silver iodobromide emulsion (AgI = 4 mole %; | 1.2 (Ag) |

-continued

| 3rd Layer: Low sensitive Red-sensitive Emulsion Layer | |
|---|---|
| uniform AgI type; diameter corresponding to sphere (Rs) = 0.5μ; coefficient of variation of Rs (C.V.) = 20%; tabular grain; diameter/thickness ratio (D/T) = 3.0) | |
| Silver iodobromide emulsion (AgI = 3 mole %; uniform AgI type; Rs = 0.3μ; C.V. = 15%; spherical grain; D/T = 1.0) | 0.6 (Ag) |
| Gelatin | 1.0 |
| ExS-1 | $4 \times 10^{-4}$ |
| ExS-2 | $5 \times 10^{-4}$ |
| ExC-1 | 0.05 |
| ExC-2 | 0.50 |
| ExC-3 | 0.03 |
| ExC-4 | 0.12 |
| ExC-5 | 0.01 |

| 4th Layer: High Sensitive Red-sensitive Emulsion Layer | |
|---|---|
| Silver iodobromide emulsion (AgI = 6 mole %; AgI content is high at the inner portion, core/shell ratio (C/S) = 1:1; Rs = 0.7μ; C.V. = 1.5%; tabular grain; D/T = 5.0) | 0.7 (Ag) |
| Gelatin | 1.0 |
| ExS-1 | $3 \times 10^{-4}$ |
| ExS-2 | $2.3 \times 10^{-4}$ |
| ExC-6 | 0.11 |
| ExC-7 | 0.05 |
| ExC-4 | 0.05 |
| Solv-1 | 0.05 |
| Solv-3 | 0.05 |

| 5th Layer: Intermediate Layer | |
|---|---|
| Gelatin | 0.5 |
| Cpd-1 | 0.1 |
| Solv-1 | 0.05 |

| 6th Layer: Low Sensitive Green-sensitive Emulsion Layer | |
|---|---|
| Silver iodobromide emulsion (AgI = 4 mole %; AgI content is high at the surface area, C/S = 1:1; Rs = 0.5μ; C.V. = 15%; tabular grain; D/T = 4.0) | 0.35 (Ag) |
| Silver iodobromide emulsion (AgI = 3 mole %; uniform AgI type; Rs = 0.3μ; C.V. = 25%; spherical grain; D/T = 1.0) | 0.20 (Ag) |
| Gelatin | 1.0 |
| ExS-3 | $5 \times 10^{-4}$ |
| ExS-4 | $3 \times 10^{-4}$ |
| ExS-5 | $1 \times 10^{-4}$ |
| ExM-8 | 0.4 |
| ExM-9 | 0.07 |
| ExM-10 | 0.02 |
| ExY-11 | 0.03 |
| Solv-1 | 0.3 |
| Solv-4 | 0.05 |

| 7th Layer: High Sensitive Green-sensitive Emulsion Layer | |
|---|---|
| Silver iodobromide emulsion (AgI = 4 mole %; AgI content is high at the inner portion, C/S = 1:3; Rs = 0.7μ; C.V. = 20%; tabular grain; D/T = 5.0) | 0.8 (Ag) |
| Gelatin | 0.5 |
| ExS-3 | $5 \times 10^{-4}$ |
| ExS-4 | $3 \times 10^{-4}$ |
| ExS-5 | $1 \times 10^{-4}$ |
| ExM-8 | 0.1 |
| ExM-9 | 0.02 |
| ExY-11 | 0.03 |
| ExC-2 | 0.03 |

-continued

| 7th Layer: High Sensitive Green-sensitive Emulsion Layer | |
|---|---|
| ExM-14 | 0.01 |
| Solv-1 | 0.2 |
| Solv-4 | 0.01 |

| 8th Layer: Intermediate Layer | |
|---|---|
| Gelatin | 0.5 |
| Cpd-1 | 0.05 |
| Solv-1 | 0.02 |

| 9th Layer: Donor Layer Having Interlayer Effect for Red-sensitive Emulsion Layer | |
|---|---|
| Silver iodobromide emulsion (AgI = 2 mole %; AgI content is high at the inner portion, C/S = 2:1; Rs = 1.0μ; C.V. = 15%; tabular grain; D/T = 6.0) | 0.35 (Ag) |
| Silver iodobromide emulsion (AgI = 2 mole %; AgI content is high at the inner portion, C/S = 1:1; Rs = 0.4μ; C.V. = 20%; tabular grain; D/T = 6.0) | 0.20 (Ag) |
| Gelatin | 0.5 |
| ExS-3 | $8 \times 10^{-4}$ |
| ExY-13 | 0.11 |
| ExM-12 | 0.03 |
| ExM-14 | 0.10 |
| Solv-1 | 0.20 |

| 10th Layer: Yellow Filter Layer | |
|---|---|
| Yellow colloidal silver | 0.05 |
| Gelatin | 0.5 |
| Cpd-2 | 0.13 |
| Solv-1 | 0.13 |
| Cpd-1 | 0.10 |

| 11th Layer: Low Sensitive Blue-sensitive Emulsion Layer | |
|---|---|
| Silver iodobromide emulsion (AgI = 4.5 mole %; uniform AgI type; Rs = 0.7μ; C.V. = 15%; tabular grain; D/T = 7.0) | 0.3 (Ag) |
| Silver iodobromide emulsion (AgI = 3 mole %; uniform AgI type; Rs = 0.3μ; C.V. = 25%; tabular grain; D/T = 7.0) | 0.15 (Ag) |
| Gelatin | 1.6 |
| ExS-6 | $2 \times 10^{-4}$ |
| ExC-16 | 0.05 |
| ExC-2 | 0.10 |
| ExC-3 | 0.02 |
| ExY-13 | 0.07 |
| ExY-15 | 1.0 |
| Solv-1 | 0.20 |

| 12th Layer: High Sensitive Blue-sensitive Emulsion Layer | |
|---|---|
| Silver iodobromide emulsion (AgI = 10 mole %; AgI content is high at the inner portion, Rs = 1.0μ; C.V. = 25%; multiple twin type tabular grain; D/T = 2.0) | 0.5 (Ag) |
| Gelatin | 0.5 |
| ExS-6 | $1 \times 10^{-4}$ |
| ExY-15 | 0.20 |
| ExY-13 | 0.01 |
| Solv-1 | 0.10 |

| 13th Layer: First Protective Layer | |
|---|---|
| Gelatin | 0.8 |
| UV-4 | 0.1 |
| UV-5 | 0.15 |
| Solv-1 | 0.01 |
| Solv-2 | 0.01 |

| 14th Layer: Second Protective Layer | |
|---|---|
| Fine grain silver iodobromide emulsion (AgI = 2 mole %; uniform AgI type; RS = 0.07μ) | 0.5 |

-continued

| 14th Layer: Second Protective Layer | |
|---|---|
| Gelatin | 0.45 |
| Polymethyl methacrylate particles (diameter = about 1.5μ) | 0.2 |
| H-1 | 0.4 |
| Cpd-5 | 0.5 |
| Cpd-6 | 0.5 |

To each layer, there were added, in addition to the foregoing components, a stabilizer for the emulsion Cpd-3 in an amount of 0.04 g/m$^2$ and a surfactant Cpd-4 as a coating aid in an amount of 0.02 g/m$^2$.

UV-1

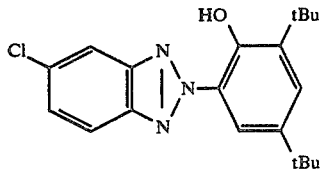

UV-2

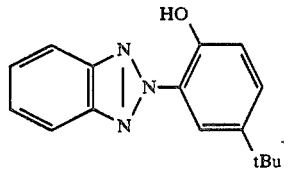

UV-3

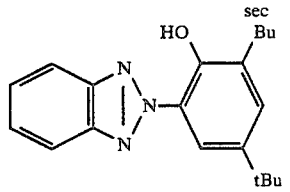

UV-4

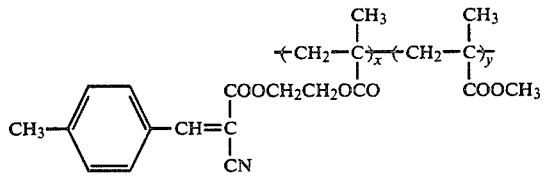

(x/y = 7/3 (weight ratio))

UV-5

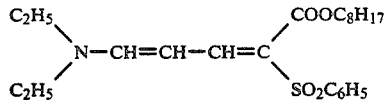

Tricresyl Phosphate — Solv-1

Dibutyl Phthalate — Solv-2

Bis(2-ethylhexyl)Phthalate — Solv-3

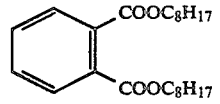

Solv-4

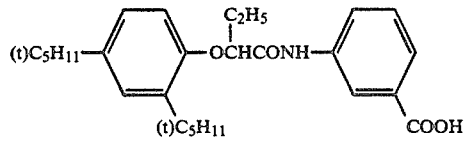

-continued
Cpd-1
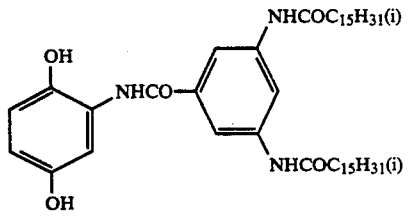
Cpd-2
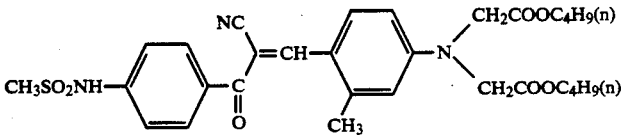
Cpd-3
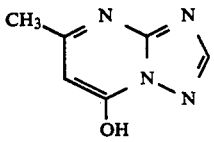
Cpd-4
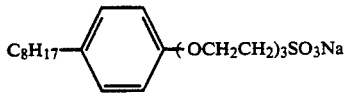
Cpd-5
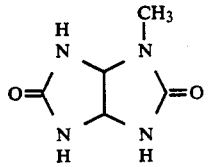
Cpd-6
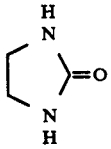
ExC-1
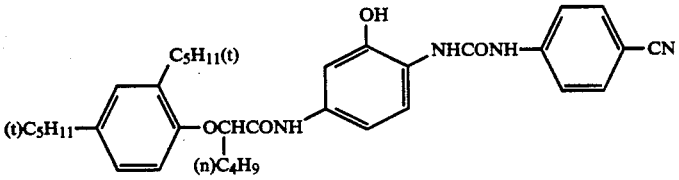
ExC-2
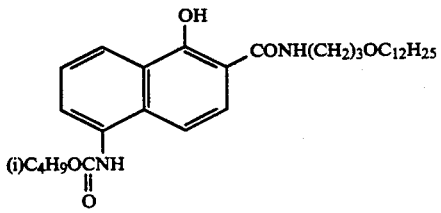

-continued
ExC-3
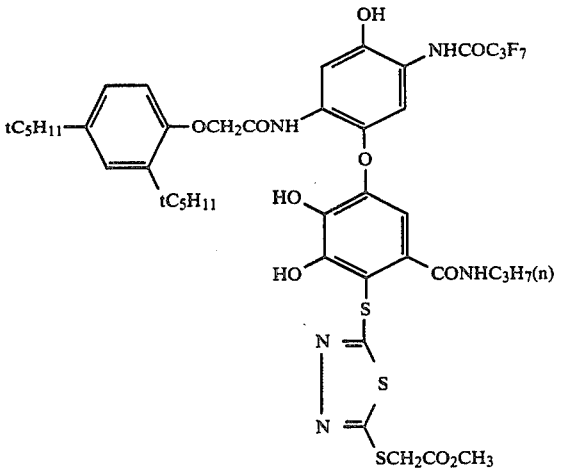
ExC-4
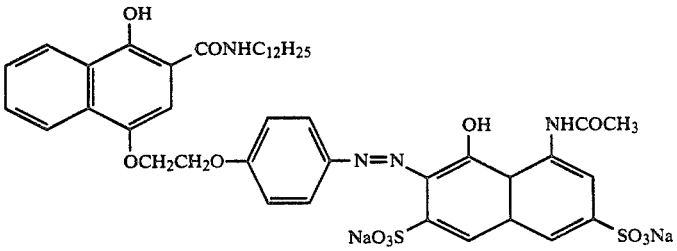
ExC-5
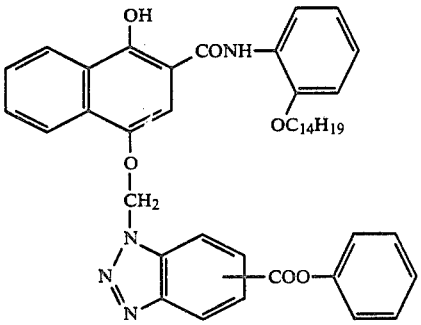
ExC-6
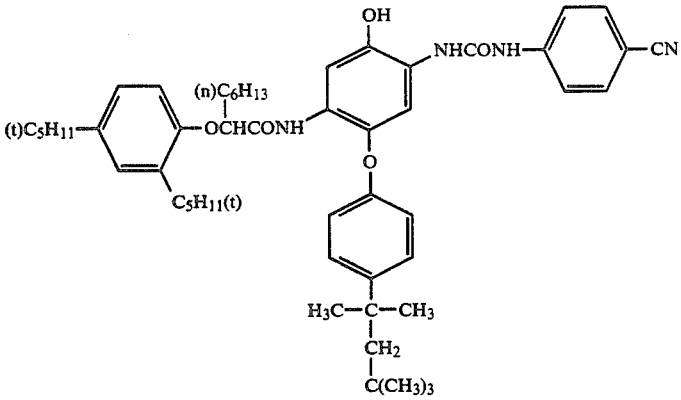
ExC-7
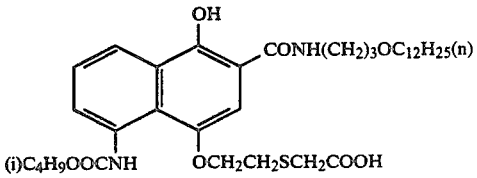

-continued
ExM-8
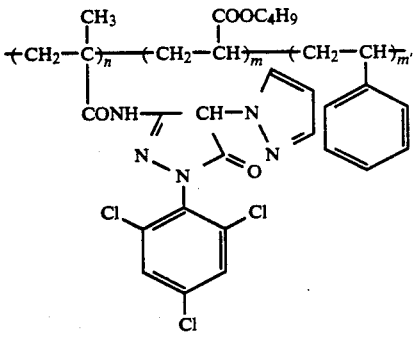
n = 50
m = 25
m' = 25
mol.wt. = about 20,000
ExM-9
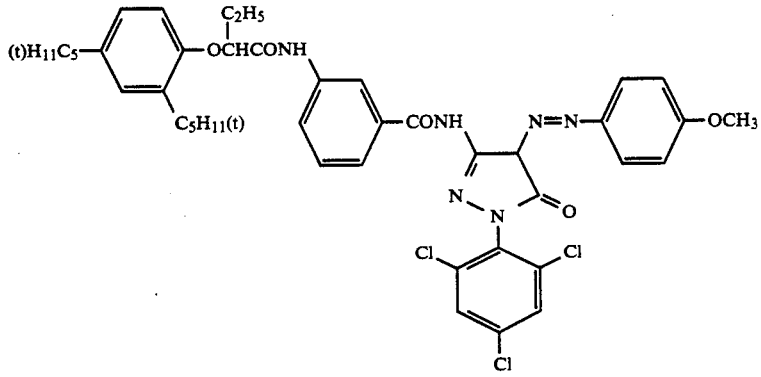
ExM-10
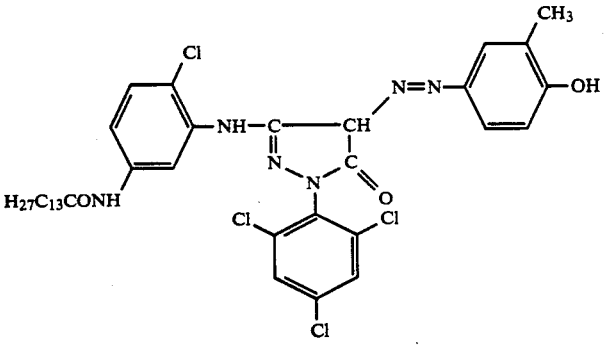
ExY-11
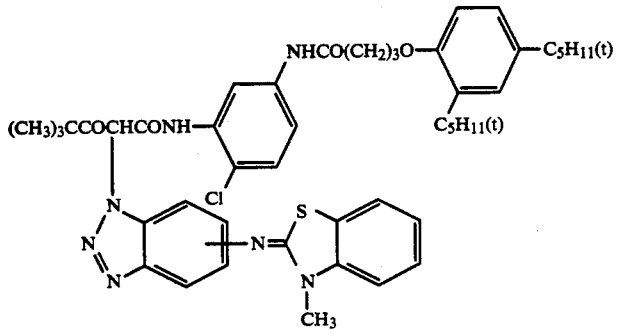

-continued
ExM-12
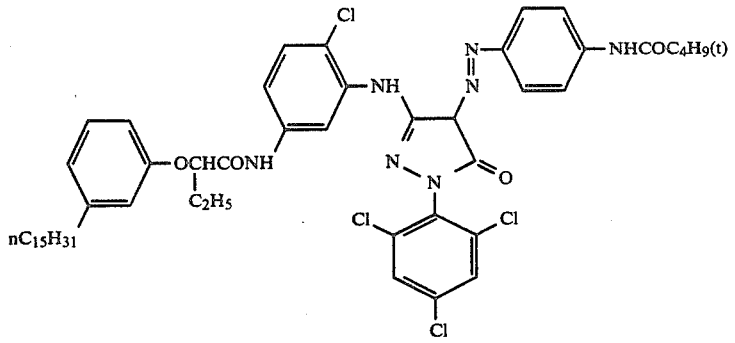
ExY-13
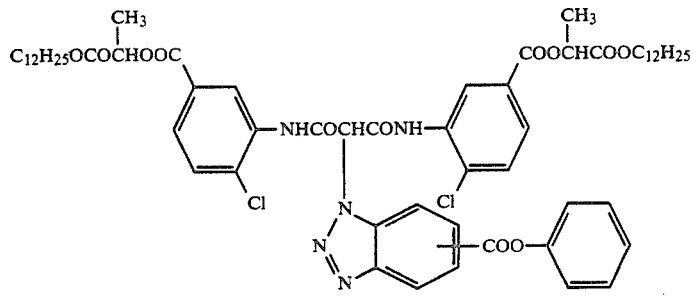
ExM-14
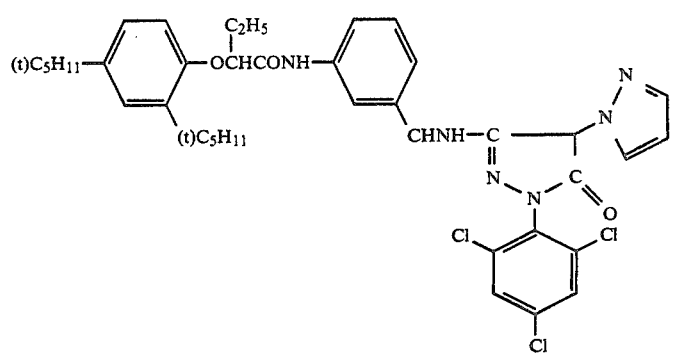
ExY-15
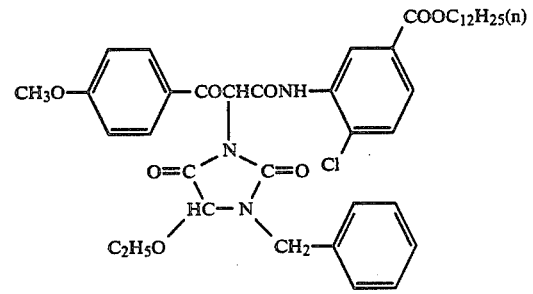

-continued
ExC-16
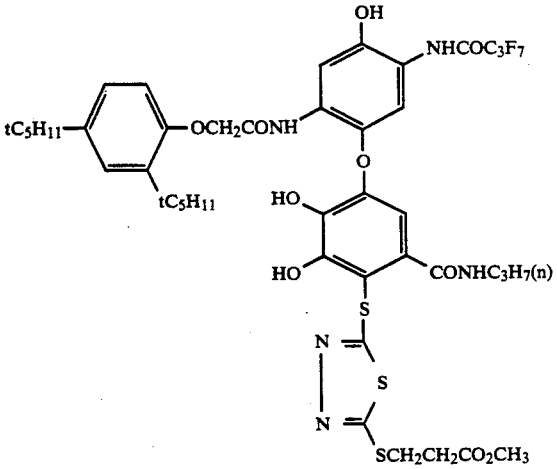
ExS-1
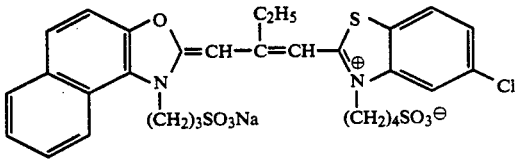
ExS-2
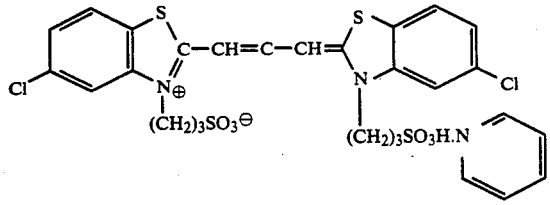
ExS-3
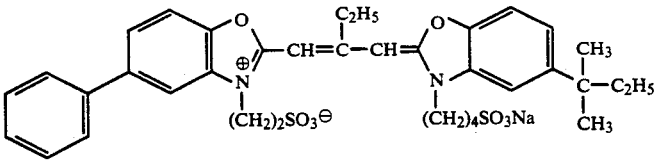
ExS-4
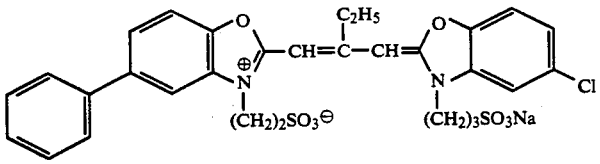
ExS-5
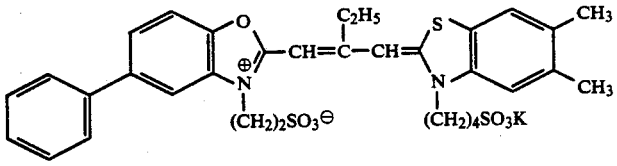
ExS-6
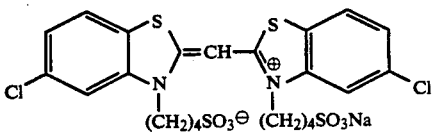
H-1
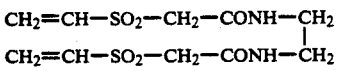

-continued

ExF-1

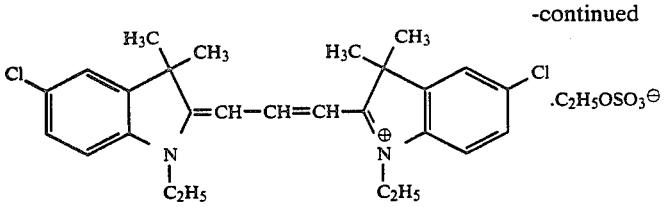

Samples 104 to 106 were prepared in the same manners as those for preparing Samples 101 to 103 except that all the silver halide emulsions were replaced with silver bromide emulsions.

The color photographic light-sensitive materials (Samples 101 to 106) prepared above were exposed to light and then were processed according to the following processes utilizing an automatic developing machine till the cumulative amount of a bleach-fixing solution replenished reached three times the volume of the tank for the mother liquor thereof.

Processing Method (A)

| Process | Processing Time (sec) | Processing Temp. (°C.) | Amount of replenisher | Volume of Tank (l) |
|---|---|---|---|---|
| Color Development | 195 | 38 | 45 | 10 |
| Bleaching | 60 | 38 | 7 | 4 |
| Bleach-fixing | 195 | 38 | 10 | 8 |
| Water Washing (1) | 40 | 35 | counter-current flow system from (2) to (1) | 4 |
| Water Washing (2) | 60 | 35 | 30 | 4 |
| Stabilization | 40 | 38 | 20 | 4 |
| Drying | 75 | 55 | — | — |

*The amount replenished is pressed in milliliters per 1 $m^2$ of the processed light-sensitive material having a width of 35 mm.

The composition of each processing solution is as follows:

(Color Developer)

| Component | Tank Soln. (g) | Replenisher (g) |
|---|---|---|
| Diethylenetriaminepentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 (mg) | — |
| Hydroxylamine sulfate | 2.4 | 2.8 |
| 4-(N-Ethyl-N-(β-hydroxyethyl)-amino)-methylaniline sulfate | 4.5 | 5.5 |
| Water | ad. 1.0 l | ad. 1.0 l |
| pH | 10.5 | 10.10 |

(Bleaching Solution): Tank Soln. and Replenisher

| | Amount (g) |
|---|---|
| Ferric ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleaching accelerator | 0.005 (mole) |

-continued (Bleaching Solution): Tank Soln. and Replenisher

| | Amount (g) |
|---|---|
| 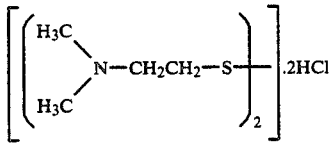 | |
| 27% Aqueous ammonia | 15.0 (ml) |
| Water | ad. 1.0 l |
| pH | 6.3 |

(Bleach-fixing Solution): Tank Soln. and Replenisher

| | Amount (g) |
|---|---|
| Ferric ammonium ethylenediaminetetraacetate dihydrate | 50.0 |
| Disodium ethylenediaminetetraacetate | 5.0 |
| Sodium sulfite | 12.0 |
| 70% Aqueous solution of ammonium thiosulfate | 280 (ml) |
| 27% Aqueous ammonia | 6.0 (ml) |
| Water | ad. 1.0 l |
| pH | 7.2 |

(Water Washing Solution): Tank Soln. and Replenisher

This was prepared by passing tap water through a mixed bed column packed with an H-type strong acidic cation-exchange resin (available from Rohm & Haas Co. Ltd. under the trade name of Amberlite IR-120B) and an OH-type anion-exchange resin (available from the same company under the trade name of Amberlite IR-400) to reduce the concentrations of calcium and magnesium ions to a level of not more than 3 mg/l, respectively and then adding 20 mg/l of sodium dichloroisocyanurate and 1.5 g/l of sodium sulfate. The pH value of the solution was in the range of 6.5 to 7.5.

(Stabilization Solution): Tank Soln. and Replenisher

| | Amount (g) |
|---|---|
| 37% Formalin | 2.0 (ml) |
| Polyoxyethylene p-monononylphenyl ether (average degree of polymerization = 10) | 0.3 |
| Disodium ethylenediaminetetraacetate | 0.05 |
| Water | ad 1.0 l |
| pH | 5.0–8.0 |

Then, a column packed with 120 ml of a strong basic anionexchange resin (available from MITSUBISHI CHEMICAL INDUSTRIES LTD. under the trade name of DIAION PA 418) was incorporated into a piping of a pumping system for circulating the bleach-fixing solution and the light-sensitive materials were continuously processed (processing method B) after imagewise exposing to light. Further, the continuous processing was performed by changing the amount of the ion-exchange resin to be packed in the column as listed in Table I. After each continuous processing, Samples which has been exposed to light (4800° K.; 100 CMS) were processed and the amount ($\mu g/cm^2$) of residual silver thereon was estimated by fluorescent X-rays technique. In addition, Samples which was not exposed to light (unexposed Samples) were likewise continuously processed and the amount of residual silver was examined. The results obtained are summarized in Table I below. In these tests, the amount (flow rate) of the processing solution circulated by the circulation pump was 5 l/min. Columns of a variety of sizes were used depending on the amount of the resin to be packed, for instance, a cylindrical column having a diameter of 4.6 cm and a length of a 12 cm was used for packaging 120 ml of the resin. Both ends thereof were sealed with fine mesh net of a plastic to confine the particulate resin in the column.

TABLE I

| Test No. | Sample No. continuously treated | Amount of Resin Used (ml) | Cumulatiave Amount of Bleach-fixing Soln. per liter of the resin (ml) | Amount of Residual Ag exposed Sample | Amount of Residual Ag unexposed Sample |
|---|---|---|---|---|---|
| 1* | 101 | 0 | — | 17.0 | 15.1 |
| 2* | 102 | 0 | — | 21.7 | 19.2 |
| 3* | 103 | 0 | — | 23.0 | 20.5 |
| 4* | 104 | 0 | — | 9.5 | 8.1 |
| 5* | 105 | 0 | — | 10.2 | 9.3 |
| 6* | 106 | 0 | — | 10.8 | 9.5 |
| 7 | 101 | 120 | 200 | 8.1 | 7.2 |
| 8 | 102 | 120 | 200 | 9.3 | 8.3 |
| 9 | 103 | 120 | 200 | 9.6 | 8.6 |
| 10 | 103 | 120 | 1000 | 9.8 | 8.7 |
| 11* | 104 | 120 | 2500 | 17.5 | 15.3 |
| 12 | 101 | 240 | 100 | 6.3 | 5.5 |
| 13 | 102 | 240 | 100 | 7.8 | 6.9 |
| 14 | 103 | 240 | 100 | 7.5 | 6.6 |
| 15 | 101 | 500 | 48 | 3.6 | 3.2 |
| 16 | 102 | 500 | 48 | 3.1 | 2.8 |
| 17 | 103 | 500 | 48 | 3.4 | 3.1 |
| 18 | 101 | 1000 | 24 | 2.1 | 2.0 |
| 19 | 102 | 1000 | 24 | 1.8 | 1.7 |
| 20 | 103 | 1000 | 24 | 1.6 | 1.5 |
| 21* | 104 | 1000 | 24 | 10.0 | 9.1 |
| 22* | 105 | 1000 | 24 | 11.3 | 10.6 |
| 23* | 106 | 1000 | 24 | 12.0 | 10.9 |
| 24 | 101 | 1200 | 20 | 3.9 | 3.5 |
| 25 | 102 | 1200 | 20 | 4.1 | 3.7 |
| 26 | 103 | 1200 | 20 | 4.2 | 3.8 |
| 27* | 101 | 2400 | 10 | 12.0 | 10.8 |
| 28* | 102 | 2400 | 10 | 12.8 | 11.5 |
| 29* | 103 | 2400 | 10 | 12.7 | 11.4 |

As seen from Table I, the residual amount of silver becomes low (exposed Samples) if the light-sensitive materials continuously processed contain silver iodide, in the processing method wherein the bleach-fixing solution is treated with an ion-exchange resin. It is thought that this is due to the enhancement in the fixing ability of the solution since there is almost no difference between the amounts of residual silver of the exposed and unexposed Samples.

EXAMPLE 2

Preparation of Tabular Silver Iodobromide Grains

Gelatin (30 g) and potassium bromide (6 g) were added to one liter of water contained in a container and an aqueous solution of silver nitrate (containing 5 g of silver nitrate) and a solution of 0.15 g of potassium iodide in water were added to the container maintained at 60° C. over one minute with stirring by a double jet technique. Moverover, an aqueous solution containing 145 g of silver nitrate and an aqueous solution containing 4.2 g of potassium iodide were also added to the container by a double jet technique. In this respect, the rate of addition of the solutions was accelerated so that the rate at the end of the addition is 5 times that at the initiation of the addition. After the addition was completed, soluble salts were removed at 35° C. by settling followed by raising the temperature to 40° C., additionally adding 75 g of gelatin and adjusting pH to 6.7. Thus, there was obtained an emulsion containing tabular silver iodobromide grains whose diameter of the projected area was 0.98$\mu$, whose average thickness was 0.138$\mu$ and whose silver iodide content was3 mole %. This emulsion was chemically sensitized by the combination of gold and ion sensitization.

A surface protective layer was ontained utilizing a gelatin solution containing polyacrylamide having an average molecular weight of 8,000, sodium polystyrene sulfonate, fine particles of polymethyl methacrylate (average particle size=3.0$\mu$), polyethylene oxide and a film hardening agent in addition to gelatin. Further, 4-hydroxy-6-methyl-1,3,3a,7-tetrazaindene, 2,6-bis(hydroxylamino)-4-diethylamino-1,3,5-triazine and nitron as stabilizers; trimethylolpropane as an antidrying and antifoggant; a coating aid, and a film hardening agent were added to obtain a coating solution. Then, the coating solution was applied to both sides of a polyethylene terephthalate substrate simultaneously with surface protective layers and was dried to form a photographic material (Sample 201). The coated amount of silver of each photographic material is listed in the following Table.

| Sensitizing Dye | KI | Coated Amount of Ag (per side) $g/m^2$ |
|---|---|---|
| Sodium salt of anhydro-5,5'-dichloro-9-ethyl-3,3'-di-(3-sulfopropyl)-oxacarbocyanine hydroxide 500 mg/l mole Ag | 200 | 2.0 |

Processing I

The processing I will be detailed below.

(Formulation of Developer): for obtaining 38 liters thereof.

| Part A | |
|---|---|
| Potassium hydroxide | 1107 g |
| Potassium sulfite | 1680 g |
| Sodium hydrogen carbonate | 285 g |
| Boric acid | 38 g |
| Diethylene glycol | 456 g |
| Ethylenediaminetetraacetic acid | 63.5 g |
| 5-Methylbenzotriazole | 2.28 g |
| Hydroquinone | 1140 g |
| Water | ad. 9.50 l |

| Part B | |
|---|---|
| Glacial acetic acid | 416.5 g |
| Diethylene glycol | 644.5 g |
| 5-Nitroindazole | 9.5 g |
| 1-Phenyl-3-pyrazolidone | 57 g |

| Part C | |
|---|---|
| Glutaraldehyde | 187.3 g |
| Sodium metabisulfite | 478.8 g |
| Water | ad. 950 ml |
| Starter | |
| Acetic acid | 270 g |
| Potassium bromide | 300 g |
| Water | ad. 1.5 l |

(Method for Preparing the Developing Solution)

20 Liters of water was introduced into a tank for storing a replenisher having a volume of about 50 liters, the aforementioned Part A, Part B and Part C were in order added thereto with stirring to dissolve these and then water was added thereto to obtain a solution of 38 liters which was used as the replenisher for developer (pH 10.30).

A tank for development of an automatic developing machine was first filled with a developer obtained by mixing the replenisher for developer with the foregoing starter in a rate of 20 ml of the latter per liter of the former (pH 10.15). Thereafter, the replenisher for developer was supplemented in a rate of 45 ml per sheet of quart (10 inch × 12 inch) as the light-sensitive materials were processed.

(Formulation of Fixing Solution): for 38 liters.

| Part A | |
|---|---|
| Ammonium thiosulfate (70 wt./vol. %) | 7.6 l |
| Disodium ethylenediaminetetraacetate dihydrate | 0.76 g |
| Sodium sulfite | 570 g |
| Boric acid | 380 g |
| Sodium hydroxide | 254.6 g |
| Acetic acid | 570 g |
| Water | ad. 9.5 l |

| Part B | |
|---|---|
| Aluminum sulfate | 380 g |
| Sulfuric acid (36 N) | 148.2 g |
| Water | ad. 1.9 l |

(Method for Preparing Fixing Solution)

20 Liters of water was introduced into a tank for storing a replenisher having a volume of about 50 liters, then the foregoing Part A and Part B were in order added thereto to dissolve these with stirring and water was added to form 38 liters of a fixing solution.

A tank for fixing treatment of an automatic developing machine was first filled with the replenisher for fixing solution as such (pH 4.25). Thereafter, the replenisher for fixing processing was supplemented to the tank in an amount of 30 ml per sheet of quart (10 inch × 12 inch) as the light-sensitive materials were processed.

| Processing I | | |
|---|---|---|
| Process | Tank Volume (l) | Processing Temp. × Time (°C. × sec.) |
| Development | 11.5 | 35 × 25 |
| Fixing | 11.5 | 35 × 20 |
| Water Washing | 11.5 | 20 × 15 |
| Drying | | 50 |

*The "dry to dry" processing time in the processing I was 96 seconds.

Then, the light-sensitive materials were continuously processed utilizing a variety of anion-exchange resins which were incorporated into a piping system of a pump for circulating the fixing solution as in Example 1 till the cumulative amount of replenisher supplemented reached three times the volume of the tank for fixing treatment, thereafter the unexposed light-sensitive material (Sample 201) was processed and then the amount of residual silver was estimated. The results observed are listed in Table II below.

TABLE II

| Test No. | Anion-ex. resin | Amount of resin (liter) | Residual Ag ($\mu g/cm^2$) |
|---|---|---|---|
| C* | — | — | 6.5 |
| D | Resin X | 1 | 2.9 |
| E | Resin Y | 1 | 1.3 |
| F | Resin Z | 1 | 0.2 |

*Comparative Example
Resin X: DIAION WA 10 (available from MITSUBISHI CHEMICAL INDUSTRIES LTD.); a weak basic ion-exchange resin.
Resin Y: Amberlite IRA-400 (available from Rohm & Haas Co. Ltd.); a strong basic anion-exchange resin.
Resin Z: Exemplary resin (19).

As seen from the results listed in Table II, preferred results in which the amount of the residual silver is very small are obtained by using strong basic anion-exchange resins as compared with those observed when the weak basic anion-exchange resin is utilized.

EXAMPLE 3

Sample 101 obtained in Example 1 was imagewise exposed to light and then continuously processed in accordance with the following process A.

| Process | Processing Time (sec) | Processing Temp. (°C.) | Amount Replenished (per 35 mm × 1 m) (ml) |
|---|---|---|---|
| Color Development | 150 | 38 | 15 |
| Bleach-fixing | 120 | 38 | 20 |
| Water Washing (1) | 20 | 38 | — |
| Water Washing (2) | 20 | 38 | 20* |
| Stabilization | 20 | 38 | 20 |
| Drying | 60 | 60 | — |

*Countercurrent flow system from water washing (2) to (1)

Each processing solution used has the following composition.

| (Color Developer) | Tank Soln. (g) | Replenisher (g) |
|---|---|---|
| Diethylenetriaminepentaacetic acid | 2.0 | 2.0 |
| 60% 1-Hydroxyethylidene-1,1-diphosphonic acid | 3.0 | 3.0 |
| Sodium sulfite | 4.0 | 7.0 |
| Potassium carbonate | 30.0 | 30.0 |
| Potassium bromide | 1.4 | — |
| Potassium iodide | 1.5 (mg) | — |
| Hydroxylamine sulfate | 2.4 | 4.0 |
| 4-[N-Ethyl-N-(β-hydroxyethylamino]-2-methylaniline sulfate | 4.5 | 8.0 |
| Water | ad. 1.0 l | ad. 1.0 l |
| pH | 10.05 | 10.25 |

| (Bleach-fixing Solution) | Tank Soln. (g) | Replenisher (g) |
|---|---|---|
| Ferric ammonium ethylene- | 90.0 | 120 |

-continued

| (Bleach-fixing Solution) | Tank Soln. (g) | Replenisher (g) |
|---|---|---|
| diaminetetraacetate dihydrate | | |
| Disodium ethylenediamine-tetraacetate | 5.0 | 5.0 |
| Sodium sulfite | 12.0 | 30 |
| 70% Aqueous solution of ammonium thiosulfate | 260.0 (ml) | 300 (ml) |
| 98% Acetic acid | 3.0 (ml) | 8.0 (ml) |
| Bleaching accelerator (III-(5)) | 0.01 (mole) | 0.015 (mole) |
| Water | ad. 1.0 l | ad. 1.0 l |
| pH | 6.5 | 6.0 |

(Water Washing Solution): Tank Soln. and Replenisher

This was prepared by passing tap water through a mixed bed column packed with an H-type strong acidic cation-exchange resin (available from Rohm & Haas Co., Ltd. under the trade name of Amberlite IR-120B) and an OH-type anion-exchange resin (available from the same company under the trade name of Amberlite IR-400) to reduce concentrations of magnesium and calcium ions to not more than 3 mg/l respectively and then adding 20 mg/l of sodium dichloroisocyanurate and 0.15 g/l of sodium sulfate.

The pH value of this solution ranges from 6.5 to 7.5.

| (Stabilization Solution): Tank Soln. & Replenisher (unit: g) | |
|---|---|
| 37% Formalin | 2.0 (ml) |
| Polyoxyethylene p-monononylphenyl ether (average degree of polymerization = 10) | 0.3 |
| Disodium ethylenediaminetetraacetate | 0.05 |
| Water | ad. 1.0 l |
| pH | 5.0–8.0 |

As in Example 1, 120 ml each of various resins was filled in a column and installed in a system for circulating a bleach-fixing solution (processings B, C, D, E, F, G and H).

6,000 m of Sample 101 was continuously processed in each processing A to H (1000 l of the bleach-fixing solution per liter of the resin). Then, Sample 101 was exposed to light (100 CMS), processed according to each processing and the amount of residual silver was determined by fluorescent-X rays technique. The results obtained are summarized in Table III (exposed Sample).

TABLE III

| Process | Resin | Amount of Residual Silver (μg/cm²) exposed Sample | unexposed Sample | Note |
|---|---|---|---|---|
| A | — | 13.5 | 10.0 | Comp. Ex. |
| B | (1) | 6.5 | 5.0 | Present Inv. |
| C | (2) | 5.3 | 4.1 | " |
| D | (3) | 2.1 | 1.9 | " |
| E | (4) | 2.0 | 1.8 | " |
| F | (5) | 1.9 | 1.7 | " |
| G | (19) | 2.0 | 1.8 | " |
| H | (48) | 2.0 | 1.8 | " |

It is found that the desilvering properties of the present invention is enhanced due to the improvement in fixing ability, since there is almost no difference between the residual amount of silver of the exposed and unexposed Samples. In particular, marked effects were obtained by the processings D to H.

EXAMPLE 4

Sample 101 obtained in Example 1 was imagewise exposed to light and then continuously processed by the following processing I.

| Process | Processing Time (sec) | Processing Temp. (°C.) | Amount Replenished (ml) (per) 35 mm × 1 m) |
|---|---|---|---|
| Color Development | 195 | 38 | 40 |
| Bleaching | 45 | 38 | 5 |
| Fixing | 60 | 38 | 15 |
| Stabilization (1) | 20 | 38 | — |
| Stabilization (2) | 20 | 38 | — |
| Stabilization (3) | 20 | 38 | 20 |
| Drying | 60 | 60 | — |

Stabilization was performed according to 3-stage countercurrent flow system from (3) to (1).

Processing solution used are as follows:

| (Color Developer) | Tank Soln. (g) | Replenisher (g) |
|---|---|---|
| Diethylenetriaminepentaacetic acid | 5.0 | 6.0 |
| Sodium sulfite | 4.0 | 4.4 |
| Potassium carbonate | 30.0 | 37.0 |
| Potassium bromide | 1.3 | 0.9 |
| Potassium iodide | 1.2 (mg) | — |
| Hydroxylamine sulfate | 2.0 | 2.8 |
| 4-[N-Ethyl-N-(β-hydroxyethylamino]-2-methylaniline sulfate | 4.7 | 5.3 |
| Water | ad. 1.0 l | ad. 1.0 l |
| pH | 10.00 | 10.05 |

| (Bleaching Solution) | Tank Soln. (g) | Replenisher (g) |
|---|---|---|
| Ferric ammonium ethylenediamine-tetraacetate dihydrate | 90 | 120 |
| Ferric 1,3-diaminopropanetetra-acetate | 50 | 60 |
| Ethylenediaminetetraacetic acid | 4.0 | 5.0 |
| Ammonium bromide | 100.0 | 160.0 |
| Ammonium nitrate | 30.0 | 50.0 |
| Aqueous ammonia (27%) | 20.0 (ml) | 23.0 (ml) |
| Acetic acid (98%) | 9.0 (ml) | 15.0 (ml) |
| Water | ad. 1.0 l | ad. 1.0 l |
| pH | 5.5 | 4.5 |

| (Fixing Solution) | Tank Soln. (g) | Replenisher (g) |
|---|---|---|
| Disodium ethylenediaminetetra-acetate | 0.5 | 0.7 |
| Sodium sulfite | 7.0 | 8.0 |
| Sodium bisulfite | 5.0 | 5.5 |
| Aqueous ammonium thiosulfate solution (70%) | 230.0 (ml) | 260.0 (ml) |
| Water | ad. 1.0 l | ad. 1.0 l |
| pH | 6.7 | 6.6 |

| (Stabilization Solution): Tank Soln & Replenisher (unit: g) | |
|---|---|
| Formalin (37%) | 1.2 (ml) |
| 5-Chloro-2-methyl-4-isothiazolin-3-one | 6.0 (mg) |
| 2-Methyl-4-isothiazolin-3-one | 3.0 (mg) |
| Surfactant $[C_{10}H_{21}—O-(CH_2—CH_2O)_{10}-H]$ | 0.4 |

-continued

| (Stabilization Solution): Tank Soln & Replenisher (unit: g) | |
|---|---|
| Ethylene glycol | 1.0 |
| Water | ad. 1.0 l |
| pH | 5.0–7.0 |

As in Example 3, ion-exchange resins were used (processings J, K, L and M). Sample 102 was exposed to light through a continuous tone wedge (at 10 CMS) and the foregoing Sample was processed at the beginning and the end of the continuous processing to determine the amount of residual silver on the maximum density region and the minimum density (Dc min) of magenta (exposed Sample). Then, unexposed Sample was likewise processed to determine the amount of residual silver. The results obtained are summarized in Table IV.

TABLE IV

| | | At the Beginning | | | At the End | | | |
|---|---|---|---|---|---|---|---|---|
| | | Amount of Ag ($\mu g/m^2$) | | | Amount of Ag ($\mu g/m^2$) | | | |
| Processing | Ion-Exchange Resin | exposed Sample | unexposed Sample | $D_G$ min | exposed Sample | unexposed Sample | $D_G$ min | |
| I | — | 2.8 | 2.7 | 0.55 | 15.7 | 15.0 | 0.63 | Comp. Ex. |
| J | (1) | 2.7 | 2.6 | 0.55 | 6.5 | 6.2 | 0.58 | Present Inv. |
| K | (3) | 2.7 | 2.6 | 0.55 | 2.8 | 2.7 | 0.55 | " |
| L | (4) | 2.7 | 2.6 | 0.55 | 2.7 | 2.6 | 0.55 | " |
| M | (5) | 2.7 | 2.6 | 0.55 | 2.7 | 2.6 | 0.55 | " |

The present invention does not cause incomplete desilvering due to insufficient fixing and any increase in magenta stain ($D_c$ min) and provides processed material having good photographic properties.

We claim:

1. A method for processing silver halide photographic light sensitive materials which comprises developing an image-wise exposed silver halide photographic light sensitive material composed of a substrate provided thereon with at least one light-sensitive silver halide emulsion layer containing silver iodide and then processing the material with a processing solution having fixing ability, wherein the processing with the processing solution having fixing ability is performed while a part of the processing solution having fixing ability is taken out of a bath containing the processing solution, brought into contact with a basic anion-exchange resin and returned to the bath, wherein the anion-exchange resin is represented by the following general formula (VIII):

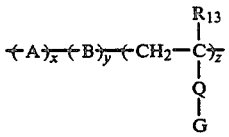

(VIII)

wherein A represents a monomer unit obtained by copolymerizing copolymerizable monomers having at least two copolymerizable ethylenically unsaturated groups at least one of which is included in the side chain; B represents a monomer unit obtained by copolymerizing copolymerizable ethylenically unsaturated monomers; $R_{13}$ represents a hydrogen atom or a lower alkyl or aralkyl group; Q represents a single bond or an alkylene, phenylene or aralkylene group or a group —CO—O—L, —CO—NH—L— or —CO—NR—L— wherein L is an alkylene; arylene or aralkylene group and R is an alkyl group; G represents

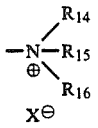

wherein $R_{14}$, $R_{15}$, and $R_{16}$ may be the same or different or may be substituted and each represents a hydrogen atom or an alkyl, aryl or aralkyl group where the total number of carbon atoms of $R_{14}$, $R_{15}$ and $R_{16}$ is not less than 12; X represents an anion; and x, y and z represent molar percentages, x ranges from 1 to 60, y from 0 to 60 and z from 30 to 100; and further wherein 20 to 2,000 l of the processing solution having fixing ability per liter of the anion-exchange resin is brought into contact with the resin.

2. The method of claim 1 wherein the content of silver iodide in the silver halide emulsion layer is not less than 1 mole %.

3. The method of claim 2 wherein the content of silver iodide in the silver halide emulsion layer ranges from 5 to 25 mol %.

4. The method of claim 1 wherein the basic anion-exchange resin is a strong basic anion-exchange resin.

5. The method of claim 1 wherein the processing with the processing solution having fixing ability is a bleach-fixing processing.

6. The method of claim 1 wherein the coated amount of silver of the light-sensitive material ranges from 2 to 10 g/m².

7. The method of claim 1 wherein the basic anion-exchange resin is a resin represented by the following general formula (IX):

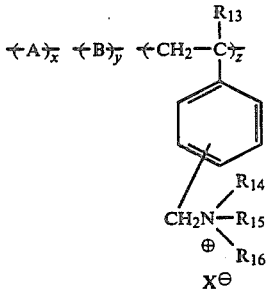

(IX)

(wherein A, B, x, y, z, $R_{13}$ to $R_{16}$ and $X^{\ominus}$ are the same as those defined above in connection with the general formula (VIII)).

8. The method of claim 1 wherein the basic anion-exchange resin is packed in a column.

9. A method of claim 8 wherein the processing solution having fixing ability is circulated through the column.

* * * * *